US006319658B1

(12) United States Patent
Lobo et al.

(10) Patent No.: US 6,319,658 B1
(45) Date of Patent: Nov. 20, 2001

(54) PHOTOPROCESSING PHOTOGRAPHIC ELEMENTS COMPRISING WATER SOLUBLE HYDROPHILIC POLYMERS

(75) Inventors: Lloyd A. Lobo; Tiecheng A. Qiao, both of Webster; Brian J. Kelley, Farmington, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/671,437

(22) Filed: Sep. 27, 2000

(51) Int. Cl.[7] ..... G03C 5/305
(52) U.S. Cl. ..... 430/434; 430/493; 430/531
(58) Field of Search ..... 430/434, 493, 430/531

(56) References Cited

U.S. PATENT DOCUMENTS

| | | | |
|---|---|---|---|
| 5,091,292 | 2/1992 | Fujimoto et al. | 430/467 |
| 5,447,817 | 9/1995 | Florens et al. | 430/139 |
| 5,853,926 | 12/1998 | Bohan et al. | 430/14 |
| 5,856,051 | 1/1999 | Yau et al. | 430/14 |
| 6,194,130 * | 2/2001 | Nair et al. | 430/350 |

OTHER PUBLICATIONS

Japanese Patent Abstract 08201994 A.
Japanese Patent Abstract 06130581 A.
Japanese Patent Abstract 05273711 A.
Japanese Patent Abstract 05273712 A.
Japanese Patent Abstract 04037847 A.
Japanese Patent Abstract 06250360 A.

* cited by examiner

*Primary Examiner*—Hoa Van Le
(74) *Attorney, Agent, or Firm*—Chris P. Konkol

(57) ABSTRACT

The present invention is also directed to a method of photoprocessing a photographic imaging element having a processing-solution-permeable overcoat that comprises at least one water-dispersible hydrophobic polymer interspersed with a water-soluble hydrophilic polymer. During photoprocessing, a surface-active water-soluble hydrophilic polymer is leached into a photoprocessing solution. However, foaming due to the hydrophilic polymer in the photoprocessing solution is prevented by the presence of a non-ionic surfactant having an HLB of less than 12.

21 Claims, No Drawings

PHOTOPROCESSING PHOTOGRAPHIC ELEMENTS COMPRISING WATER SOLUBLE HYDROPHILIC POLYMERS

FIELD OF THE INVENTION

The present invention relates to a method of photoprocessing a photographic imaging element having a processing-solution-permeable overcoat comprising a water-dispersible hydrophobic polymer interspersed with a water-soluble hydrophilic polymer. During photoprocessing, the water-soluble hydrophilic polymer is leached into a photoprocessing solution, resulting in a water-resistant overcoat after photoprocessing. Foaming in the photoprocessing solution is prevented by the presence of a non-ionic surfactant having an HLB of less than 12.

BACKGROUND OF THE INVENTION

Silver halide photographic elements contain light sensitive silver halide in a hydrophilic emulsion. An image is formed in the element by exposing the silver halide to light, or to other actinic radiation, and developing the exposed silver halide to reduce it to elemental silver.

In color photographic elements, a dye image is formed as a consequence of silver halide development by one of several different processes. The most common is to allow a by-product of silver halide development, oxidized silver halide developing agent, to react with a dye forming compound called a coupler. The silver and unreacted silver halide are then removed from the photographic element, leaving a dye image.

In either case, formation of the image commonly involves liquid processing with aqueous solutions that must penetrate the surface of the element to come into contact with silver halide and coupler. Thus, gelatin or similar natural or synthetic hydrophilic polymers have proven to be the binders of choice for silver halide photographic elements. Unfortunately, when gelatin or similar polymers are formulated so as to facilitate contact between the silver halide crystals and aqueous processing solutions, the resultant coatings are not as fingerprint and stain resistant as would be desirable, particularly in view of the handling or environment that imaged photographic elements commonly experience under various circumstances. Thus, fingerprints can permanently mark conventional photographic elements. They can be easily stained by common household products, such as foods or beverages, for example, coffee spills.

There have been attempts over the years to provide protective layers for gelatin based photographic systems that will protect the images from damages by water or aqueous solutions. A number of patents have been directed to water-resistant protective coatings that can be applied to a photographic element prior to development. For example, U.S. Pat. No. 2,706,686 describes the formation of a lacquer finish for photographic emulsions, with the aim of providing water- and fingerprint-resistance by coating the light-sensitive layer, prior to exposure, with a porous layer that has a high degree of water permeability to the processing solutions. After processing, the lacquer layer is fused and coalesced into a continuous, impervious coating. The porous layer is achieved by coating a mixture of a lacquer and a solid removable extender (ammonium carbonate), and removing the extender by sublimation or dissolution during processing. The overcoat as described is coated as a suspension in an organic solvent, and thus is not desirable for large-scale application. More recently, U.S. Pat. No. 5,853,926 to Bohan et al. discloses a protective coating for a photographic element, involving the application of an aqueous coating comprising polymer particles and a soft polymer latex binder. This coating allows for appropriate diffusion of photographic processing solutions, and does not require a coating operation after exposure and processing. Again, however, the hydrophobic polymer particles must be fused to form a protective coating that is continuous and water-impermeable.

U.S. Pat. No. 5,856,051 describes the use of hydrophobic particles with gelatin as the binder in an overcoat formulation. This invention demonstrated an aqueous coatable, water-resistant protective overcoat that can be incorporated into the photographic product, allows for appropriate diffusion of photographic processing solutions, and does not require a coating operation after exposure and processing. The hydrophobic polymers exemplified in U.S. Pat. No. 5,856,051 include polyethylene have a melting temperature (Tm) of 55 to 200° C., and are therefore capable of forming a water-resistant layer by fusing the layer at a temperature higher than the Tm of the polymer after the sample has been processed to generate the image. The coating solution is aqueous and can be incorporated in the manufacturing coating operation without any equipment modification. Again, fusing is required by the photofinishing laboratories to render the protective overcoat water-resistant. This patent discloses that the incorporation of water soluble polymers at 5 to 45% by weight based on the total dry laydown of the overcoat layer can improve the developability and dye formation rate of the imaging formation layer. During processing, the water soluble polymers are removed from the coating. The average molecular weight of the water-soluble polymers is between 1,000 and 200,000. The patent lists a wide variety of non-ionic, anionic or cationic water-soluble polymers, including polyacrylamides and poly(vinyl alcohol).

Applicants have found that hydrophilic polymers in photoprocessing solutions at concentrations greater than 0.01 weight percent can be foam stabilizers, thereby causing the solutions to foam. Depending on the mode and level of agitation in the photoprocessing solutions, the severity of this problem can inhibit or even shut down the operation of a photoprocessing lab. There are two main problems that can occur when a stable foam is formed: (1) the foam can cause an increase in the volume of the processing solutions, and (2) the presence of foam can inhibit the wetting of the photographic element as it enters the processing solution, thereby causing a non-uniformity in the upperscale density area.

Chemical antifoamers in the prior art can be classified as one of two distinct types: (1) defoamers that break up a foam, and (2) insoluble organic materials. The details of the way these materials act to defoam as well as a broad range of examples are given in "Defoaming," P. R. Garrett Ed., *Surfactant Science Series,* Vol. 45 (Marcel Dekker, N.Y. 1993).

Examples of the first type of antifoamer, defoamers that break up a foam, are alcohols such as butyl alcohol, octyl alcohol, and the like. A deficiency of these materials is that their antifoaming action is short term. That is, they are able to break the foam at the time of addition, but cannot prevent subsequent formation of foam. They need to be added continuously, therefore, resulting in relatively large quantities of these materials accumulating in the solution. Examples of the second type of antifoamer, insoluble organic materials, are silicone oil, paraffin oils and dispersions of organic oils with silica particles in water. Frequently, these materials are made more effective by adding hydrophobic silica particles. These materials are quite effective at relatively low concentrations and have a sustained antifoaming action. Also, these materials are non-volatile. A characteristic of these materials are that they are either two phases or three phases in the aqueous medium. Consequently, while these materials work well to control foaming, they have the inherent problem of low shelf stability. The silica particles, due to their high density, usually settle out, while silicone oils rise to the surface. They also can contaminate hardware by sticking or coating the surfaces. Photoprocessing solutions are expected to have stability between the time of manufacture and the time of use, which may be on the order of months.

Surfactants have been used in photoprocessing for various reasons. The use of surfactants in developing solutions for silver halide imaging elements have been disclosed mainly to aid wetting of the imaging element. Japanese Kokai JP08201994 (1994) discloses an aminoacid-type surfactant to improve wetting. U.S. Pat. No. 5,447,817 discloses an anionic surfactant in the developer to prevent "pi marks" for X-ray film. Japanese Kokai JP-06130581 discloses the use of a nonionic surfactant in the developer for a B&W silver halide imaging element, to improve processing uniformity. Surfactants required to improve wettability are typically used at relatively high concentrations in order to reduce the surface tension of the processing solution. Surfactants have also been used in developer solutions to reduce the formation of deposits or "tar." Japanese Kokai JP-05273712 and JP-05273711 disclose a nonionic surfactant in the developer solution to process an imaging element containing a fluorosurfactant in the antistat layer, to prevent scumming. Japanese Kokai JP-2915091 discloses the use of an ethoxylated surfactant in the developer solution containing sulfite, to minimize deposition of tar like material during processing. Surfactants have also been disclosed for use in developing solutions to minimize stain in the processed imaging elements. Japanese Kokai JP-06250360 discloses the use of a water soluble surfactant in the developer in order to reduce the replenishment rate in the stabilizer and still minimize stain. U.S. Pat. No. 5,091,292 discloses the use of anionic surfactants to reduce stain upon photoprocessing.

It would be desirable to improve the photoprocessing of photographic imaging elements having a nascent water-resistant overcoat. Furthermore, it would be desirable that to improve the photoprocessing of photographic imaging elements that have an overcoat formulation comprising at least one water-dispersible hydrophobic polymer interspersed with a water-soluble hydrophilic polymer that is leached into a photoprocessing solution.

SUMMARY OF THE INVENTION

An object of this invention is to minimize foam during the photoprocessing of photographic elements comprising an overcoat wherein one of the components of the overcoat is a water-soluble hydrophilic polymer that is leached into at least one processing solution. This is accomplished by the use of an antifoaming agent designed to prevent the formation of foam caused by the presence of the hydrophilic polymer in the processing solution. The selected antifoam agent is soluble or easily dispersed as fine particles such that the photoprocessing solution has a good shelf stability. The antifoam agent is sufficiently potent to control foam at concentrations that do not adversely affect the reactivity or the functionality of the processing solution. These and other objects of the invention are accomplished by using, as an antifoam in the photoprocessing solution, a nonionic surfactant with an HLB number less than 12, having a solubility in water at 25° C. of greater than 200 parts per million, which surfactant is used in the photoprocessing solution in an amount of less than 1000 ppm.

DESCRIPTION OF THE PREFERRED EMBODIMENTS

The present invention provides a simple and inexpensive way to improve the photoprocessing of photographic elements having a nascent protective overcoat applied over the photographic element prior to exposure and processing. The overcoat formulation is applied to the emulsion side of photographic products, particularly photographic prints, which may encounter frequent handling and abuse by end users.

By the term "water-resistant" is meant herein after ordinary photoprocessing and drying, the photographic element does not imbibe water or prevents it and that water-based stains are prevented from discoloring the imaged side of the photographic element.

The present method is used to process photographic elements having an overcoat comprising a mixture of a hydrophobic polymer and a hydrophilic polymer. During the photoprocessing, the hydrophilic polymer facilitates the permeation of water soluble species which are required to convert the latent image into a silver based image or a colored dye image. In the process, the hydrophilic polymer leaches out of the overcoat into one or more photoprocessing solutions, such that at the end of the said photoprocessing the amount of hydrophilic polymer retained in the overcoat is none or small compared to the hydrophobic polymer, thereby converting the overcoat to a non-staining hydrophobic overcoat due to the nature of the residual hydrophobic polymer. In other words, the function of these hydrophilic polymers is to provide a permeability switch in the overcoat to help it convert from a hydrophilic water permeable overcoat into a hydrophobic water impermeable overcoat that is stain resistant.

In the present invention, the hydrophilic polymer in the overcoat leaches into a photoprocessing solution, at least in part due to its relatively low molecular weight. Photographic elements having leachable hydrophilic polymers in an overcoat have been disclosed in commonly assigned U.S. Ser. Nos. 09/235,437, 09/313556, 09/448213, 09/621,267 and 09/665,463, all hereby incorporated by reference in their entirety. Alternately, a relatively high molecular weight film-forming hydrophilic polymer, like gelatin or starch, may be used in the overcoat, if the molecular weight of the hydrophilic polymer is reduced during photoprocessing. In the case of gelatin in the overcoat, a crosslinker that is used for crosslinking the gelatin in the light sensitive layers will also act on the gelatin in the overcoat when the overcoat is simultaneously coated with the light sensitive layers. This chemical crosslinking of the gelatin in the overcoat increases the molecular weight of the gelatin by one or more orders of magnitude. In order to cause leaching of a high-molecular weight or crosslinked polymer in the overcoat to occur, it is necessary to reduce the molecular weight of the polymer. This can be achieved by incorporating a hydrolyzing agent for the polymer, either in the coating or in the photoprocessing solution, as disclosed in commonly assigned U.S. Ser. Nos. 09/547,374, 09/591,430, and 09/665,463 . One example of a hydrolyzing agent is an enzyme. For example, proteases can be used to hydrolyze proteins like gelatin, whereas amylases can be used to hydrolyze certain starches.

Accordingly, photographic elements processed according to the present invention have overcoats comprising a combination of two polymers: (1) a hydrophobic polymer and (2) a water-soluble hydrophilic polymer that either has a low molecular weight in the overcoat prior as manufactured (prior to photoprocessing) or else has a relatively high molecular weight but which can be hydrolyzed to reduce its molecular weight during the photoprocessing process.

In the present process, the hydrophilic polymer leaches into at least one photoprocessing solution and usually is present in this solution at levels up to 0.3 weight percent. The hydrophilic polymers, like soluble gelatin and poly (vinyl alcohol), are mildly surface active. By "surface active" is meant that they lower the interfacial tension of the solution that they are added too. The greater their ability to lower the surface tension, the higher is their surface activity. In addition, they can also increase the viscosity of the solution. The presence of surface-active polymeric materials increases the propensity of the processing solutions to form a foam. Processing solutions typically require a large amount of agitation, which method of agitation may depend on the configuration of the processor. In any case, the agitation is necessary to minimize the concentration gradients of the reactants and thereby reduce processing variability. This agitation, however, typically leads to entrainment of air, which in the case of solutions that contain surface active materials, will cause foam.

It has been determined that, since hydrophilic polymers such as poly(vinyl alcohol) are not highly surface active, as defined by their ability to lower surface tension, a new class of antifoaming agents can be used to control foam. According to the invention, certain surfactants can be use as antifoaming agents, which surfactants do not interact with the hydrophilic polymer and do not themselves foam at the low concentrations that are used. In order to work, these materials are required to displace and replace the hydrophilic polymers from the surfaces of the air bubbles at fairly low concentrations. At the same time, these materials are sufficiently soluble or easily dispersed into fine particles (<10 nm) so that they have a high shelf stability in the processing solutions.

The antifoaming agents used in this invention have HLB numbers below 12. In essence, the HLB number of a surface active material is used to specify the nature of an oil/water dispersion that is formed in the presence of the surface active material. If the HLB is less than 7, the dispersed (the drop) phase will be water. If the HLB is above 12, the dispersed phase is oil. It can also be used to predict its ability to form a foam, where oil is replaced by air. In a congruent manner, if the surface active material has an HLB number of 12 or greater, the higher is its probability of stabilizing a foam. In the photoprocessing solution containing the leached hydrophilic polymer, the antifoaming agent, which is a surface active material, is expected to completely displace and replace hydrophilic polymer at the surface of the air bubbles. Additionally, the new adsorbed layer should not be a stabilizer for foams. Thus, the requirement that the antifoaming agent have a HLB number less than 12. On the other hand, if the HLB is too low, the solubility of the surface active material in the aqueous phase will be too low to provide an effective active concentration, in the aqueous phase, for the antifoaming agent to work. Also, if the solubility is low, the antifoaming agent will be dispersed as large drops, which can create problems in the shelf stability and functionality of the photoprocessing solution.

The HLB of surface active materials can be measured or calculated. There are several methods of measuring HLB. These methods are listed in "Nonionic Surfactants", Ed. M. Schick, "Surfactant Science Series", Vol. 1, Marcel Deker Inc., New York, 1967. A technique using gas chromatography is commonly used, where the surface active material is deposited on an acid washed chromatographic resin—Chromosorb® P resin from an acetone solution. A column, 3 ft long and ¼ inch in diameter is prepared. With the column maintained at 80° C., a 3.0 $\mu$l sample of a standard 1:1 ethanol/hexane solution is injected into the instrument. The retention times of each peak are measured and the ratio P of the retention time of ethanol to hexane is calculated. P is directly related to the HLB value of the surface active material as reported by Becher and Birkmeier, J. American Oil Chemists' Soc., Vol. 41, p 8, 1964. The HLB number is usually reported by surfactant manufacturers, or else, it can be approximately calculated by the preferred method described in the above reference.

There are several kinds of nonionic surfactants that meet the requirements for the antifoaming agent of the present invention. These include ethoxylated alcohols having the generic formula $R—O(CH_2CH_2O)_nH$ where R can be alkyl, aryl or aralkyl with 2–30 carbon atoms and n can vary from 2 to 20. The HLB of the ethoxylated alcohols is related to ratio of the number of ethylene oxide groups to the number of carbon atoms in the R group. A subset of this class of materials are fluorinated surfactants or ethoxylated fluorocarbons, where all or some of the hydrogen atoms in the R group are substituted by fluorine atoms. Another class of materials are block copolymers of ethylene oxide and propylene oxide. Examples of these are Pluronics™ (poloxamers) which are triblock copolymers and Tetronics™ (poloxamines), which are tetrafunctional block copolymers derived from the sequential addition of propylene oxide and ethylene oxide to ethylenediamine. The ratio of the propylene oxide to the ethylene oxide amounts is directly related to the HLB of the surfactant. Another class of materials are based on derivatives of mono and disaccharides, including sorbitol esters such as SPANS™, and alkyl glucosides and hydrophobic sucrose esters such as sucrose distearate. Another class of materials are polyalkylene-modified poly(dimethylsiloxanes), or alkoxylated PDMS materials, including those containing ethylene oxide as well as ethylene oxide and propylene oxide and having HLB values in the range defined by this invention. Examples of these surfactants are Silwet™.

The antifoaming agents used in the present invention are typically used in relatively small amounts. Based on their medium HLB values, these surfactants have limited solubility in aqueous solutions. In addition, since most of them have an ethylene oxide block as the hydrophilic entity, these surfactants have a cloud point, which is the highest temperature at which the surfactant is soluble in water. Above this temperature, the ethylene oxide groups lose their water of hydration and therefore make the surfactant insoluble. Photoprocessing operations typically take place between about 30 and 40° C. Therefore, it is important that these surfactants be used at levels below their solubility limit at the operating temperature. In general, the amount required is that which can completely displace the hydrophilic polymer from the surface. Due to their high surface activity compared to the low surface activity of the hydrophilic polymers, levels between 20 and 1000, preferably less than about 500 parts per million are sufficient to accomplish defoaming. More preferably, the amount is between 50 and 200 ppm.

The present method of processing can be applied to a variety of photographic elements comprising a processing-solution-permeable overcoat that provides water resistance in the final product. Such a photographic element typically comprises a support, at least one silver-halide emulsion layer superposed on the support, and overlying the silver-halide emulsion layer, the processing-solution-permeable protective overcoat composition that is incorporated into or coated on the imaging element during manufacturing and that does not inhibit photographic processing. Thus, as indicated above, a component of the invention are hydrophobic polymer particles that are water-dispersible. The material of the invention can be introduced to the overcoat coating melt in a latex form or as a conventional colloidal dispersion in a hydrophilic binder. The presence of the hydrophilic component that is substantially washed out during processing allows photographic processing to proceed at an acceptable rate. The washing out of the hydrophilic component facilitates the coalescence of the hydrophobic materials in the final product, further facilitated by elevated temperatures commonly associated with drying.

As indicated above, the present method of photoprocessing is applicable to photographic elements having overcoats that comprise a mixture of a hydrophobic polymer and a water-soluble hydrophilic polymer. One class of overcoats are described in U.S. Ser. Nos. 09/235,437, 09/313,556, 09/448,213 and 09/621,267 and comprise polyurethane polymers with acid groups as the hydrophobic polymers and a variety of hydrophilic polymers. The hydrophilic polymers include polyvinyl alcohol, polyvinyl pyrolidone, and gelatin. In order for these polymers to wash out during the photoprocessing operation, their molecular weight should be typically less than 100,000. The hydrophilic polymers are in the overcoat at levels from 10% to 100% based on the amount of the hydrophobic polymer. Thus, the amount of the hydrophilic polymers in the overcoat can be up to 400 mg/ft$^2$. The preferred amount of the hydrophilic polymer is between 20 and 100 mg/ft$^2$. Other hydrophobic materials have also been disclosed in combination with the same set of hydrophilic polymers. The types of the hydrophobic materials that can be present in the overcoat, in describing this invention, are not restricted to those described above. Based on the size of the tanks in a typical photoprocessing operation, and the replenishment rates of the chemicals and the assumption that up to 100% of the hydrophilic polymer can wash out in one of the photoprocessing steps, it is estimated that the concentration of the hydrophilic polymer in the photoprocessing solution could reach as high as 3 gms/ lit. Typically, if the concentration of the hydrophilic polymer exceeds 0.2 gms /lit, it has the potential to cause a foaming problem.

Another kind of overcoat on a photographic element that may be processed according to the present invention comprises a mixture of gelatin and a hydrophobic polymer latex. The gelatin comprises from 10 to 50% of the total amount of material in the overcoat. It is preferred to coat this overcoat, in a multilayer coating, simultaneously with the gelatin containing layers of the imaging element. In practice, coating of gelatin containing imaging layers and elements are carried out in the presence of a chemical crosslinker, by whose action the gelatin molecular weight is increased several fold. This is done to prevent dissolution of the gelatin and the subsequent disintegration of the coating, when the coatings are immersed in warm aqueous photoprocessing solutions. Thus, the gelatin in the overcoat is also chemically crosslinked, which then makes it initially insoluble in processing solutions. Consequently, one or more proteolytic enzymes can be added to one or more processing solutions at levels that are adequate to hydrolyze the gelatin in the overcoat alone. During the photoprocessing, a substantial amount of gelatin (hydrolyzed by the enzyme) is leached into the photoprocessing solutions. This leaves the overcoat with the hydrophobic polymer which can then form a water impermeable-barrier.

Another kind of overcoat on a photographic element that may be processed according to the present invention is one that contains gelatin, hydrophobic polymer, and a proteolytic enzyme, the latter being introduced at the time of coating. Yet another embodiment is one in which the proteolytic enzyme is coated in a separate non-gelatin layer, adjacent to the overcoat. In both these embodiments, the proteolytic enzyme hydrolyzes the gelatin, at the time of coating and/or at the time the coating is rewet, i.e. during processing. The hydrolyzed gelatin leaches out of the overcoat into the photoprocessing solutions.

In one embodiment of the invention, a photographic element is processed in which the overcoat composition applied to the photographic element comprises 30 to 95 weight percent, based on the dry laydown of the overcoat, of water-dispersible polymer particles having an average of between 0.01 to 0.5 micrometers, said water-dispersible polymer being characterized by a $T_g$ (glass transition temperature) of between −40 and 80° C.

In another embodiment of the invention, a photographic element is processed which comprises: (a) a support; (b) at least one silver-halide emulsion layer superposed on a side of said support; and overlying the silver emulsion layer, (c) a processing-solution-permeable protective overcoat having a laydown of at least 0.54 g/m$^2$ (50 mg/f$^2$) made from an overcoat formulation that is substantially gelatin-free, comprising less than 5% crosslinked gelatin by weight of solids. In general, the overcoat composition contains a water-soluble, hydrophilic polymer that is essentially or substantially non-crosslinked to facilitate its washing out during processing and, at least to some extent, to facilitate the coalescence of the water-dispersible polymer particles.

Without wishing to be bound by theory, it is believed that the formation of a water-resistant overcoat that does not require fusing, but merely elevated temperatures preferably up to about 60° C., may be facilitated by (a) the substantial absence of cross-linked gelatin and other such crosslinked polymers in the overcoat, and (b) the selection of a water-dispersible polymer that is forms a biphasic system with the hydrophilic water-soluble polymer, but which after processing forms a water-resistant overcoat.

In another embodiment of the invention, a photographic element is processed in which the applied overcoat composition comprises about of 30 to 95% weight of solids, preferably 60 to 90 weight percent, of water-dispersible polymer particles having an average particle size of less than 500 nm and a $T_g$ between −40 to 80° C., preferably 10° C. to 60° C., and 5 to 70%, by weight of solids, preferably 10 to 40 weight percent, of a water-soluble hydrophilic polymer such that more than 30 weight percent of the water-soluble polymer is washed out during photographic processing; wherein the weight ratio of the water-dispersible polymer to the non-crosslinked hydrophilic polymer is between 50:50 to 90:10, preferably 60:40 to 85:15, whereby the overcoat forms a water-resistant overcoat after photoprocessing without fusing, namely by maintaining the photographic element at an elevated temperature less than 100° C. By the term "elevated temperature," as used in this application, is herein meant a temperature of less than 100° C., preferably from 30 to 80° C., more preferably 45 to 60° C., which temperature is effective to dry and/or facilitate coalescence of the water-dispersible polymer. In contrast, fusing typically requires a pressure roller or belt and drying of the imaged element before fusing. Fusing generally requires higher temperatures, typically above the boiling point of water, usually above 100° C.

The production of a water-resistant protective layer on the photographic element can be facilitated by coalescing the residual water-dispersible polymer material in the imaging element at a temperature sufficiently high, preferably during the drying step, after the photographic material has been photochemically processed. The absence or presence of less than 5% by weight of crosslinked gelatin or other crosslinked hydrophilic polymer in the overcoat (as applied) can allow proper coalescence during such a drying step. (It is noted that although some gelatin from underlying layers in the photographic element may migrate into the overcoat, during manufacture or photochemical processing, any such migration is limited and, by definition, is not included in the composition formulation.) However, fusing may be used to form a continuous overcoat in the absence of complete coalescence.

The dispersions of hydrophobic polymers used in this invention are latexes or hydrophobic polymers of any composition that can be stabilized in an water-based medium. Such hydrophobic polymers are generally classified as either condensation polymer or addition polymers. Condensation polymers include, for example, polyesters, polyamides, polyurethanes, polyureas, polyethers, polycarbonates, polyacid anhydrides, and polymers comprising combinations of the above-mentioned types. Addition polymers are polymers formed from polymerization of vinyl-type monomers including, for example, allyl compounds, vinyl ethers, vinyl heterocyclic compounds, styrenes, olefins and halogenated olefins, unsaturated acids and esters derived form them, unsaturated nitrites, vinyl alcohols, acrylamides and methacrylamides, vinyl ketones, multifunctional monomers, or copolymers formed from various combinations of these monomers. Such latex polymers can be prepared in aqueous media using well-known free radical emulsion polymerization methods and may consist of homopolymers made from one type of the above-mentioned monomers or copolymers made from more than one type of the above-mentioned monomers. Polymers comprising monomers which form water-insoluble homopolymers are preferred, as are copolymers of such monomers. Preferred polymers may also comprise monomers which give water-soluble homopolymers, if the overall polymer composition is sufficiently water-insoluble to form a latex. Further listings of suitable monomers for addition type polymers are found in U.S. Pat. No. 5,594,047 incorporated herein by reference. The polymer can be prepared by emulsion polymerization, solution polymerization, suspension polymerization, dispersion polymerization, ionic polymerization (cationic, anionic), Atomic Transfer Radical Polymerization, and other polymerization methods known in the art of polymerization. The selection of water-dispersible particles to be used in the overcoat is based on the material properties one wishes to have as the protective overcoat in addition to water resistance.

The water-dispersible polymer may be selected so that fusing is or is not required or is optional. Polymers not requiring fusing include, for example, amorphous, thermoplastic polymers having ionized or ionizable groups or moieties in sufficient number to provide water dispersibility prior to coating. In addition to water-resistance, the polymer dispersions in the finally processed product preferably provides further advantageous properties such as good chemical and stain resistance, wet-abrasion resistance, fingerprint resistance, toughness, elasticity, durability, and/or resistance to various oils.

In the case of carboxylic acid ionic groups, the polymer can be characterized by the acid number, which is preferably greater than or equal to 5 and relatively permeable to water at a pH of greater than 7. Preferably, the acid number is less than or equal to 40, more preferably less than or equal to 30. Preferably, the pH of the developing solution is greater than 8, preferably greater than 9. The water-reducible water-dispersible polymer particles comprising ionized or ionizable groups may be branched, unbranched, crosslinked, uncrosslinked.

The hydrophilic polymer in the overcoat comprises at least one water-soluble hydrophilic polymer. Examples of such water-soluble polymers include polyvinyl alcohol, cellulose ethers, poly(N-vinyl amides), polyacrylamides, polyesters, poly(ethylene oxide), dextrans, starch, uncrosslinked gelatin or crosslinked gelatin, whey, albumin, poly(acrylic acid), poly(ethyl oxazolines), alginates, gums, poly(methacrylic acid), poly(oxymethylene), poly (ethyleneimine), poly(ethylene glycol methacrylate), poly (hydroxy-ethyl methacrylate), poly(vinyl methyl ether), poly(styrene sulfonic acid), poly(ethylene sulfonic acid), poly(vinyl phosphoric acid) and poly(maleic acid) and the like and combinations thereof. Such materials are included in "Handbook of Water-Soluble Gums and Resins" by Robert l. Davidson (McGraw-Hill Book Company, 1980) or "Organic Colloids" by Bruno Jirgensons (Elsvier Publishing Company, 1958). In a preferred embodiment, the polymer is polyvinyl alcohol, which polymer has been found to yield coatings that are relatively uniform and to enhance the diffusion rate of the developer into the underlying emulsions.

The preferred hydrophilic polymer is polyvinyl alcohol. The term "polyvinyl alcohol" referred to herein means a polymer having a monomer unit of vinyl alcohol as a main component. Polyvinyl alcohol is typically prepared by substantial hydrolysis of polyvinyl acetate. Such a "polyvinyl alcohol" includes, for example, a polymer obtained by hydrolyzing (saponifying) the acetate ester portion of a vinyl acetate polymer (exactly, a polymer in which a copolymer of vinyl alcohol and vinyl acetate is formed), and polymers obtained by saponifying a trifluorovinylacetate polymer, a vinyl formate polymer, a vinyl pivalate polymer, a tert-butylvinylether polymer, a trimethylsilylvinylether polymer, and the like (the details of "polyvinyl alcohol" can be referred to, for example, "World of PVA", Edited by the Poval Society and Published by Kobunshi Kankoukai, Japan., 1992 and "Poval", Edited by Nagano et al. and Published by Kobunshi Kankoukai, Japan, 1981). The degree of hydrolysis (or saponification) in the polyvinyl alcohol is preferably at least about 70% or more, more preferably at least about 80%. Percent hydrolysis refers to mole percent. For example, a degree of hydrolysis of 90% refers to polymers in which 90 mol % of all copolymerized monomer units of the polymer are vinyl alcohol units. The remainder of all monomer units consists of monomer units such as ethylene, vinyl acetate, vinyl trifluoroacetate and other comonomer units which are known for such copolymers. Most preferably, the polyvinyl alcohol has a weight average molecular weight (MW) of less than 150,000, preferably less than 100,000, and a degree of hydrolysis greater than 70%. If the MW is greater than 100,000, the degree of hydrolysis is preferably less than 95%. Preferably, the degree of hydrolysis is 85 to 90% for a polyvinyl alcohol having a weight average MW of 25,000 to 75,000. These preferred limitations may provide improved manufacturability and processibility. The polyvinyl alcohol is selected to make the coating wettable, readily processable, and in a substantial amount, to readily, not sluggishly, come out of the coating during processing, thereby yielding the final water-resistant product. The optimal amount of polyvinyl alcohol depends on the amount of dry coverage of water-dispersible polymer. In one preferred embodiment of the invention, the polyvinyl alcohol is present in the overcoat in the amount between 1 and 60 weight percent of the water-dispersible polymer, preferably between 5 and 50 weight percent of the water-dispersible polymer, most preferably between 10 and 45 weight percent of the water-dispersible polymer.

Optionally, the coating composition in accordance with the invention may also contain suitable crosslinking agents for crosslinking the water-dispersible polymer. Such an additive can improve the adhesion of the overcoat layer to the substrate below as well as contribute to the cohesive strength of the layer. Crosslinkers such as epoxy compounds, polyfunctional aziridines, methoxyalkyl melamines, triazines, polyisocyanates, carbodiimides, polyvalent metal cations, and the like may all be considered. If a crosslinker is added, care must be taken that excessive amounts are not used as this will decrease the permeability of the processing solution. The crosslinker may be added to the mixture of water-dispersible component and any additional polymers.

The optimal amount of the water-soluble hydrophilic polymer may depend on the amount of dry coverage of water-dispersible polymer, but is appropriately used in an amount greater than 0.1 $g/m^2$ (10 $mg/ft^2$). For example, in the case of the combination of a polyurethane polymer and a polyvinyl alcohol polymer, if coverage of a polyurethane polymer is 1.08 $g/m^2$ (100 $mg/ft^2$) or less, then about 20% or less of polyvinyl alcohol, by weight of the polyurethane, provides good results, whereas for higher coverage, for example (1.88 $g/m^2$) 175 $mg/ft^2$, greater than about 25% of the polyvinyl alcohol provides comparably good results.

In one preferred embodiment, the water-dispersible polymer of this invention are polyurethanes, preferably segmented polyurethanes. Polyurethanes are the polymerization reaction product of a mixture comprising polyol monomers and polyisocyanate monomers. The term "polyurethane", as used herein, includes branched and unbranched copolymers, as well as IPN and semi-IPNs comprising at least two polymers, at least one of which is a polyurethane. Preparation of an aqueous dispersion of a polyurethane-containing component, when a single copolymer, is well known in the art. In a preferred method of preparation, the first step is the formation of a medium molecular weight isocyanate terminated prepolymer by the reaction of suitable di or polyol with a stoichiometric excess of di or polyisocyanates. The prepolymer is then generally dispersed in water via water-solubilizing/dispersing groups that are introduced either into the prepolymer prior to chain extension, or are introduced as part of the chain extension agent. Therefore, small particle size stable dispersions can frequently be produced without the use of an externally added surfactant. The prepolymer in the aqueous solution is then subjected to chain extension using diamines or diols to form the "fully reacted" polyurethane.

Some examples of polyurethane-containing components used in the practice of this invention that are commercially available include NeoPac® R-9000, R-9699 and R-9030 from NeoResins (Wilmington, Del.), Sancure® AU4010 from BF Goodrich (Akron, Ohio), and Flexthane® 620, 630, 790 and 791 from Air Products. An example of the polyurethane-containing copolymer useful in the practice that is commercially available is the NeoRez® R9679.

In another embodiment of the invention, the water-dispersible polymer is an essentially hydrophobic, substantially amorphous, thermoplastic polyester polymer in which ionic groups or moieties are present in sufficient number to provide water dispersibility prior to coating. The polyester dispersions provide advantageous properties such as good film-formation, good chemical-resistance, wet-abrasion resistance, excellent fingerprint resistance, toughness, elasticity and durability. Furthermore, the polyesters exhibit tensile and flexural strength and resistance to various oils.

Procedures for the preparation of polyester ionomers are described in U.S. Pat. Nos. 3,018,272; 3,563,942; 3,734,874; 3,779,993; 3,929,489; 4,307,174, 4,395,475, 5,939,355 and 3,929,489, the disclosures of which are incorporated herein by reference. The substantially amorphous polyesters useful in this invention comprise dicarboxylic acid recurring units typically derived from dicarboxylic acids or their functional equivalents and diol recurring units typically derived from diols. Generally, such polyesters are prepared by reacting one or more diols with one or more dicarboxylic acids or their functional equivalents (e.g. anhydrides, diesters or diacid halides), as described in detail in the cited patents. Such diols, dicarboxylic acids and their functional equivalents are sometimes referred to in the art as polymer precursors. It should be noted that, as known in the art, carbonylimino groups can be used as linking groups rather than carbonyloxy groups. This modification is readily achieved by reacting one or more diamines or amino alcohols with one or more dicarboxylic acids or their functional equivalents. Mixtures of diols and diamines can be used if desired.

Conditions for preparing the polyesters useful in this invention are known in the art as described above. The polymer precursors are typically condensed in a ratio of at least 1 mole of diol for each mole of dicarboxylic acid in the presence of a suitable catalyst at a temperature of from about 125° to about 300° C. Condensation pressure is typically from about 0.1 mm Hg to about one or more atmospheres. Low-molecular weight by-products can be removed during condensation, e.g. by distillation or another suitable technique. The resulting condensation polymer is polycondensed under appropriate conditions to form a polyester. Polycondensation is usually carried out at a temperature of from about 150° to about 300° C. and a pressure very near vacuum, although higher pressures can be used.

Polyester ionomers, useful in the present composition, contain at least one ionic moiety, which can also be referred to as an ionic group, functionality, or radical. In a preferred embodiment of the invention, the recurring units containing ionic groups are present in the polyester ionomer in an amount of from about 1 to about 12 mole percent, based on the total moles of recurring units. Such ionic moieties can be provided by either ionic diol recurring units and/or ionic dicarboxylic acid recurring units, but preferably by the latter. Such ionic moieties can be anionic or cationic in nature, but preferably, they are anionic. Exemplary anionic ionic groups include carboxylic acid, sulfonic acid, and disulfonylimino and their salts and others known to a worker of ordinary skill in the art. Sulfonic acid ionic groups, or salts thereof, are preferred.

As indicated above, the hydrophilic polymer according to the present invention can include gelatin if substantially non-crosslinked and, thus, substantially water-soluble. For example, in one embodiment of the invention, the overcoat is applied to the imaging element as a composition comprising 10 to 50% by weight gelatin and 50 to 90% by weight of water-dispersible particles (by weight of dry laydown of the entire overcoat) having an average diameter of 10 to 500 nm. Since gelatin comprises a substantial portion of the overcoat layer, photographic elements containing this overcoat are readily manufactured using conventional photographic coating equipment. A proteolytic enzyme can be applied to the element in reactive association with the overcoat layer. The layer containing the overcoat polymer and the enzyme can be applied either in the same coating operation (using a slide hopper or other means of applying multiple layers) at the same time with the imaging layer, in a sequential coating operation (using a separate coating station) with the imaging layer, or in a separate coating operation (at a later time to an element having at least one previously applied, dried, and hardened imaging layer), to produce a photographic element comprising a gelatin-containing overcoat. Typically, the gelatin in the overcoat layer is substantially hydrolyzed or degraded (digested) by the enzyme before the photochemical processing of the imaged element. Advantageously, a photographic element according to one embodiment of the invention can be exposed and processed using normal photofinishing equipment, with no modifications, to provide an imaged element that possesses a protective, water-resistant layer.

The protective overcoat should be clear, i.e., transparent, and is preferably colorless. But it is specifically contemplated that the polymer overcoat can have some color for the purposes of color correction, or for special effects, so long as it does not detrimentally affect the formation or viewing of the image through the overcoat. Thus, there can be incorporated into the polymer a dye that will impart color or tint. In addition, additives can be incorporated into the polymer that will give the overcoat various desired properties. For example, a UV absorber may be incorporated into the polymer to make the overcoat UV absorptive, thus protecting the image from UV induced fading. Other compounds may be added to the coating composition, depending on the functions of the particular layer, including surfactants, emulsifiers, coating aids, lubricants, matte particles, rheology modifiers, crosslinking agents, antifoggants, inorganic fillers such as conductive and nonconductive metal oxide particles, pigments, magnetic particles, biocide, and the like. The coating composition may also include a small amount of organic solvent, preferably the concentration of organic solvent is less than 1 percent by weight of the total coating composition. The invention does not preclude coating the desired polymeric material from a volatile organic solution or from a melt of the polymer.

Examples of coating aids include surfactants, viscosity modifiers and the like. Surfactants include any surface-active material that will lower the surface tension of the coating preparation sufficiently to prevent edge-withdrawal, repellencies, and other coating defects. These include alkyloxy- or alkylphenoxypolyether or polyglycidol derivatives and their sulfates, such as nonylphenoxypoly(glycidol) available from Olin Matheson Corporation or sodium octylphenoxypoly(ethyleneoxide) sulfate, organic sulfates or sulfonates, such as sodium dodecyl sulfate, sodium dodecyl sulfonate, sodium bis(2-ethylhexyl)sulfosuccinate (Aerosol® OT), and alkylcarboxylate salts such as sodium decanoate.

The surface characteristics of the overcoat are in large part dependent upon the physical characteristics of the polymers which form the continuous phase and the presence or absence of solid, nonfusible particles. However, the surface characteristics of the overcoat also can be modified by the conditions under which the surface is optionally fused. For example, in contact fusing, the surface characteristics of the fusing element that is used to fuse the polymers to form the continuous overcoat layer can be selected to impart a desired degree of smoothness, texture or pattern to the surface of the element. Thus, a highly smooth fusing element will give a glossy surface to the imaged element, a textured fusing element will give a matte or otherwise textured surface to the element, a patterned fusing element will apply a pattern to the surface of the element, etc.

Matte particles well known in the art may also be used in the coating composition of the invention, such matting agents have been described in *Research Disclosure* No. 308119, published December 1989, pages 1008 to 1009. When polymer matte particles are employed, the polymer may contain reactive functional groups capable of forming covalent bonds with the binder polymer by intermolecular crosslinking or by reaction with a crosslinking agent in order to promote improved adhesion of the matte particles to the coated layers. Suitable reactive functional groups include hydroxyl, carboxyl, carbodiimide, epoxide, aziridine, vinyl sulfone, sulfinic acid, active methylene, amino, amide, allyl, and the like.

In order to reduce the sliding friction of the photographic elements in accordance with this invention, the water-dispersible polymers may contain fluorinated or siloxane-based components and/or the coating composition may also include lubricants or combinations of lubricants. Typical lubricants include (1) silicone based materials disclosed, for example, in U.S. Pat. Nos. 3,489,567, 3,080,317, 3,042,522, 4,004,927, and 4,047,958, and in British Patent Nos. 955, 061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc., disclosed in U.S. Pat. Nos. 2,454,043; 2,732,305; 2,976,148; 3,206,311; 3,933,516; 2,588,765; 3,121,060; 3,502,473; 3,042,222; and 4,427,964, in British Patent Nos. 1,263,722; 1,198,387; 1,430,997; 1,466,304; 1,320,757; 1,320,565; and 1,320,756; and in German Patent Nos. 1,284,295 and 1,284,294; (3) liquid paraffin and paraffin or wax like materials such as carnauba wax, natural and synthetic waxes, petroleum waxes, mineral waxes, silicone-wax copolymers and the like; (4) perfluoro- or fluoro- or fluorochloro-containing materials, which include poly(tetrafluoroethylene), poly(trifluorochloroethylene), poly(vinylidene fluoride, poly(trifluorochloroethylene-co-vinyl chloride), poly(meth)acrylates or poly(meth)acrylamides containing perfluoroalkyl side groups, and the like. Lubricants useful in the present invention are described in further detail in *Research Disclosure* No.308119, published December 1989, page 1006.

The support material used with this invention can comprise various polymeric films, papers, glass, and the like. The thickness of the support is not critical. Support thicknesses of 2 to 15 mils (0.002 to 0.015 inches) can be used. Biaxially oriented support laminates can be used with the present invention. These supports are disclosed in commonly owned U.S. Pat. Nos. 5,853,965, 5,866,282, 5,874,205, 5,888,643, 5,888,681, 5,888,683, and 5,888,714, incorporated in their entirety by reference herein. These supports include a paper base and a biaxially oriented polyolefin sheet, typically polypropylene, laminated to one or both sides of the paper base. At least one photosensitive silver halide layer is applied to the biaxially oriented polyolefin sheet.

The coating composition of the invention can be applied by any of a number of well known techniques, such as dip coating, rod coating, blade coating, air knife coating, gravure coating and reverse roll coating, extrusion coating, slide coating, curtain coating, and the like. After coating, the layer is generally dried by simple evaporation, which may be accelerated by known techniques such as convection heating. Known coating and drying methods are described in further detail in *Research Disclosure* No. 308119, Published December 1989, pages 1007 to 1008. Preferably, a commercial embodiment involve simultaneous co-extrusion. After applying the coating composition to the support, it may be dried over a suitable period of time, for example 2 to 4 minutes.

Photographic elements can contain conductive layers incorporated into multilayer photographic elements in any of various configurations depending upon the requirements of the specific photographic element. Preferably, the conductive layer is present as a subbing or tie layer underlying a magnetic recording layer on the side of the support opposite the photographic layer(s). However, conductive layers can be overcoated with layers other than a transparent magnetic recording layer (e.g., abrasion-resistant backing layer, curl control layer, pelloid, etc.) in order to minimize the increase in the resistivity of the conductive layer after overcoating. Further, additional conductive layers also can be provided on the same side of the support as the photographic layer(s) or on both sides of the support. An optional conductive subbing layer can be applied either underlying or overlying a gelatin subbing layer containing an antihalation dye or pigment. Alternatively, both antihalation and antistatic functions can be combined in a single layer containing conductive particles, antihalation dye, and a binder. Such a hybrid layer is typically coated on the same side of the support as the sensitized emulsion layer. Additional optional layers can be present as well. An additional conductive layer can be used as an outermost layer of an photographic element, for example, as a protective layer overlying an image-forming layer. When a conductive layer is applied over a sensitized emulsion layer, it is not necessary to apply any intermediate layers such as barrier or adhesion-promoting layers between the conductive overcoat layer and the photographic layer(s), although they can optionally be present. Other addenda, such as polymer lattices to improve dimensional stability, hardeners or cross-linking agents, surfactants, matting agents, lubricants, and various other well-known additives can be present in any or all of the above mentioned layers.

Conductive layers underlying a transparent magnetic recording layer typically exhibit an internal resistivity of less than $1\times10^{10}$ ohms/square, preferably less than $1\times10^{9}$ ohms/square, and more preferably, less than $1\times10^{8}$ ohms/square.

Photographic elements of this invention can differ widely in structure and composition. For example, the photographic elements can vary greatly with regard to the type of support, the number and composition of the image-forming layers, and the number and types of auxiliary layers that are included in the elements. In particular, photographic elements can be still films, motion picture films, x-ray films, graphic arts films, paper prints or microfiche. It is also specifically contemplated to use the conductive layer of the present invention in small format films as described in *Research Disclosure,* Item 36230 (June 1994). Photographic elements can be either simple black-and-white or monochrome elements or multilayer and/or multicolor elements adapted for use in a negative-positive process or a reversal process. Generally, the photographic element is prepared by coating one side of the film support with one or more layers comprising a dispersion of silver halide crystals in an aqueous solution of gelatin and optionally one or more subbing layers. The coating process can be carried out on a continuously operating coating machine wherein a single layer or a plurality of layers are applied to the support. For multicolor elements, layers can be coated simultaneously on the composite film support as described in U.S. Pat. Nos. 2,761,791 and 3,508,947. Additional useful coating and drying procedures are described in *Research Disclosure,* Vol. 176, Item 17643 (December 1978).

Photographic elements protected in accordance with this invention may be derived from silver-halide photographic elements that can be black and white elements (for example, those which yield a silver image or those which yield a neutral tone image from a mixture of dye forming couplers), single color elements or multicolor elements. Multicolor elements typically contain dye image-forming units sensitive to each of the three primary regions of the spectrum. The imaged elements can be imaged elements which are viewed by transmission, such a negative film images, reversal film images and motion-picture prints or they can be imaged elements that are viewed by reflection, such a paper prints. Because of the amount of handling that can occur with paper prints and motion picture prints, they are the preferred imaged photographic elements for use in this invention.

While a primary purpose of applying an overcoat to imaged elements in accordance with this invention is to protect the element from physical damage, application of the overcoat may also protect the image from fading or yellowing. This is particularly true with elements that contain images that are susceptible to fading or yellowing due to the action of oxygen. For example, the fading of dyes derived from pyrazolone and pyrazoloazole couplers is believed to be caused, at least in part, by the presence of oxygen, so that the application of an overcoat which acts as a barrier to the passage of oxygen into the element will reduce such fading.

Photographic elements in which the images to be protected are formed can have the structures and components shown in Research Disclosures 37038 and 38957. Other structures which are useful in this invention are disclosed in commonly owned U.S. Ser. No. 09/299,395, filed Apr. 26, 1999 and U.S. Ser. No. 09/299,548, filed Apr. 26, 1999, incorporated in their entirety by reference. Specific photographic elements can be those shown on pages 96–98 of Research Disclosure 37038 as Color Paper Elements 1 and 2. A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler.

The photographic element can contain additional layers, such as filter layers, interlayers, overcoat layers, subbing layers, and the like. All of these can be coated on a support that can be transparent (for example, a film support) or reflective (for example, a paper support). Photographic elements protected in accordance with the present invention may also include a magnetic recording material as described in *Research Disclosure,* Item 34390, November 1992, or a transparent magnetic recording layer such as a layer containing magnetic particles on the underside of a transparent support as described in U.S. Pat. Nos. 4,279,945 and 4,302,523.

Suitable silver-halide emulsions and their preparation, as well as methods of chemical and spectral sensitization, are described in Sections I through V of Research Disclosures 37038 and 38957. Others are described in U.S. Ser. No. 09/299,395, filed Apr. 26, 1999 and U.S. Ser. No. 09/299,548, filed Apr. 26, 1999, which are incorporated in their entirety by reference herein. Color materials and development modifiers are described in Sections V through XX of Research Disclosures 37038 and 38957. Vehicles are described in Section II of Research Disclosures 37038 and 38957, and various additives such as brighteners, antifoggants, stabilizers, light absorbing and scattering materials, hardeners, coating aids, plasticizers, lubricants and matting agents are described in Sections VI through X and XI through XIV of Research Disclosures 37038 and 38957. Processing methods and agents are described in Sections XIX and XX of Research Disclosures 37038 and 38957, and methods of exposure are described in Section XVI of Research Disclosures 37038 and 38957.

Photographic elements typically provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like). Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like.

Photographic elements can be imagewise exposed using a variety of techniques. Typically exposure is to light in the visible region of the spectrum, and typically is of a live image through a lens. Exposure can also be to a stored image (such as a computer stored image) by means of light emitting devices (such as LEDs, CRTs, etc.).

Images can be developed in photographic elements in any of a number of well known photographic processes utilizing any of a number of well known processing compositions, described, for example, in T. H. James, editor, *The Theory of the Photographic Process,* 4th Edition, Macmillan, New York, 1977. In the case of processing a color negative element, the element is treated with a color developer (that is one which will form the colored image dyes with the color couplers), and then with an oxidizer and a solvent to remove silver and silver halide. In the case of processing a color reversal element, the element is first treated with a black and white developer (that is, a developer which does not form colored dyes with the coupler compounds) followed by a treatment to render developable unexposed silver halide (usually chemical or light fogging), followed by treatment with a color developer. Development is followed by bleach-fixing, to remove silver or silver halide, washing and drying.

In one embodiment of a method of using a composition according to the present invention, a photographic element may be provided with a processing-solution-permeable overcoat having the above described composition overlying the silver halide emulsion layer superposed on a support. The photographic element is developed in an alkaline developer solution having a pH greater than 7, preferably greater than 8, more preferably greater than 9. Suitably at least 50%, more preferably greater than 75% of the original amount of hydrophilic polymer, such as PVA, in the overcoat is washed out during processing of the exposed photographic element, such that the final product is depleted in hydrophilic polymer and hence relatively more water resistant. Although the processing-solution-permeable overcoat does not require fusing, optional fusing may improve the water resistance further. In a continuous processing environment, the concentration of the hydrophilic polymer will build up. It has been calculated that the amount of hydrophilic polymer such as PVA in a continuous processing machine can exceed 0.02 g/L and can become as high as 0.1 g/L.

The overcoat layer in accordance with this invention is particularly advantageous for use with photographic prints due to superior physical properties including excellent resistance to water-based spills, fingerprinting, fading and yellowing, while providing exceptional transparency and toughness necessary for providing resistance to scratches, abrasion, blocking, and ferrotyping.

The photoprocessing process, in addition to the use of a non-ionic surfactant as described above, can utilize any of a number of well-known processing compositions, described, for example, in *Research Disclosure II,* or in T. H. James, editor, *The Theory of the Photographic Process,* 4th Edition, Macmillan, New York, 1977. The development process may take place for a specified length of time and temperature, with minor variations, which process parameters are suitable to render an acceptable image. Preferably, the photoprocessing steps are based on the conventional RA-4 photoprocessing, with the addition of the antifoam agent according to the present invention.

The developing agents are typically of the phenylenediamine type, as described below. Preferred color developing agents are p-phenylenediamines. The color developer composition can be easily prepared by mixing a suitable color developer in a suitable solution. Water can be added to the resulting composition to provide the desired composition. The pH can be adjusted to the desired value with a suitable base such as sodium hydroxide. The color developer solution for wet-chemical development can include one or more of a variety of other addenda which are commonly used in such compositions, such as antioxidants, alkali metal halides such as potassium chloride, metal sequestering agents such as aminocarboxylic acids, buffers to maintain the pH from about 9 to about 13, such as carbonates, phosphates, and borates, preservatives, development accelerators, optical brightening agents, wetting agents, surfactants, and couplers as would be understood to the skilled artisan. The amounts of such additives are well known in the art.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, Research Disclosure, Vol. 116, December, 1973, Item 11660, and Bissonette Research Disclosure, Vol. 148, August, 1976, Items 14836, 14846 and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Development is followed by desilvering, such as bleach-fixing, in a single or multiple steps, typically involving tanks, to remove silver or silver halide, washing and drying. The desilvering in a wet-chemical process may include the use of bleaches or bleach fixes. Bleaching agents of this invention include compounds of polyvalent metal such as iron (III), cobalt (III), chromiumn (VI), and copper (II), persulfates, quinones, and nitro compounds. Typical bleaching agents are iron (III) salts, such as ferric chloride, ferricyanides, bichromates, and organic complexes of iron (III) and cobalt (III). Polyvalent metal complexes, such as ferric complexes, of aminopolycarboxylic acids and persulfate salts are preferred bleaching agents, with ferric complexes of aminopolycarboxylic acids being preferred for bleach-fixing solutions. Preferred aminopolycarboxylic acids include 1,3-propylenediamine tetraacetic acid, methyliminodiactic acid and ethylenediamine tetraacetic acid. The bleaching agents may be used alone or in a mixture of two or more; with useful amounts typically being at least 0.02 moles per liter of bleaching solution, with at least 0.05 moles per liter of bleaching solution being preferred. Examples of ferric chelate bleaches and bleach-fixes, are disclosed in DE 4,031,757 and U.S. Pat. Nos. 4,294,914; 5,250,401; 5,250,402; EP 567,126; 5,250,401; 5,250,402 and U.S. patent application Ser. No. 08/128,626 filed Sep. 28, 1993.

Typical persulfate bleaches are described in Research Disclosure, December 1989, Item 308119, published by Kenneth Mason Publications, Ltd., Dudley Annex, 12a North Street, Emsworth, Hampshire P010 & DQ, England, the disclosures of which are incorporated herein by reference. This publication will be identified hereafter as Research Disclosure BL. Useful persulfate bleaches are also described in Research Disclosure, May, 1977, Item 15704; Research Disclosure, August, 1981, Item 20831; and DE 3,919,551. Sodium, potassium and ammonium persulfates are preferred, and for reasons of economy and stability, sodium persulfate is most commonly used.

A bleaching composition may be used at a pH of 2.0 to 9.0. The preferred pH of the bleach composition is between 3 and 7. If the bleach composition is a bleach, the preferred pH is 3 to 6. If the bleach composition is a bleach-fix, the preferred pH is 5 to 7. In one embodiment, the color developer and the first solution with bleaching activity may be separated by at least one processing bath or wash (intervening bath) capable of interrupting dye formation. This intervening bath may be an acidic stop bath, such as sulfuric or acetic acid; a bath that contains an oxidized developer scavenger, such as sulfite; or a simple water wash. Generally an acidic stop bath is used with persulfate bleaches.

Examples of counterions which may be associated with the various salts in these bleaching solutions are sodium, potassium, ammonium, and tetraalkylammonium cations. It may be preferable to use alkali metal cations (especially sodium and potassium cations) in order to avoid the aquatic toxicity associated with ammonium ion. In some cases, sodium may be preferred over potassium to maximize the solubility of the persulfate salt. Additionally, a bleaching solution may contain anti-calcium agents, such as 1-hydroxyethyl-1, 1-diphosphonic acid; chlorine scavengers such as those described in G. M. Einhaus and D. S. Miller, Research Disclosure, 1978, vol 175, p. 42, No. 17556; and corrosion inhibitors, such as nitrate ion, as needed.

Bleaching solutions may also contain other addenda known in the art to be useful in bleaching compositions, such as sequestering agents, sulfites, non-chelated salts of aminopolycarboxylic acids, bleaching accelerators, re-halogenating agents, halides, and brightening agents. In addition, water-soluble aliphatic carboxylic acids such as acetic acid, citric acid, propionic acid, hydroxyacetic acid, butyric acid, malonic acid, succinic acid and the like may be utilized in any effective amount. Bleaching compositions may be formulated as the working bleach solutions, solution concentrates, or dry powders. The bleach compositions of this invention can adequately bleach a wide variety of photographic elements in 30 to 240 seconds.

Bleaches may be used with any compatible fixing solution. Examples of fixing agents which may be used in either the fix or the bleach fix are water-soluble solvents for silver halide such as: a thiosulfate (e.g., sodium thiosulfate and ammonium thiosulfate); a thiocyanate (e.g., sodium thiocyanate and ammonium thiocyanate); a thioether compound (e.g., ethylenebisthioglycolic acid and 3,6-dithia-1,8-octanediol); or a thiourea. These fixing agents can be used singly or in combination. Thiosulfate is preferably used. The concentration of the fixing agent per liter is preferably about 0.2 to 2 mol. The pH range of the fixing solution is preferably 3 to 10 and more preferably 5 to 9. In order to adjust the pH of the fixing solution an acid or a base may be added, such as hydrochloric acid, sulfuric acid, nitric acid, acetic acid, bicarbonate, ammonia, potassium hydroxide., sodium hydroxide, sodium carbonate or potassium carbonate.

The fixing or bleach-fixing solution may also contain a preservative such as a sulfite (e.g., sodium sulfite, potassium sulfite, and ammonium sulfite), a bisulfite (e.g., ammonium bisulfite, sodium bisulfite, and potassium bisulfite), and a metabisulfite (e.g., potassium metabisulfite, sodium metabisulfite, and ammonium metabisulfite). The content of these compounds is about 0 to 0.50 mol/liter, and more preferably 0.02 to 0.40 mol/liter as an amount of sulfite ion. Ascorbic acid, a carbonyl bisulfite acid adduct, or a carbonyl compound may also be used as a preservative.

The above mentioned bleach and fixing baths may have any desired tank configuration including multiple tanks, counter current and/or co-cur rent flow tank configurations. A stabilizer bath is commonly employed for final washing and hardening of the bleached and fixed photographic element prior to drying. Alternatively, a final rinse may be used. A bath can be employed prior to color development, such as a prehardening bath, or the washing step may follow the stabilizing step. Other additional washing steps may be utilized. Conventional techniques for processing are illustrated by Research Disclosure BL, Paragraph XIX.

Examples of how processing of a film according to the present invention in a wet-chemical process may occur are as follows:

(1) development→bleaching→fixing (2) development→bleach fixing (3) development→bleach fixing→fixing (4) development→bleaching→bleach fixing (5) development→bleaching→bleach fixing→fixing (6) development→bleaching→washing→fixing (7) development→washing or rinsing→bleaching→fixing (8) development→washing or rinsing→bleach fixing (9) development→fixing→bleach fixing

(10) development→stopping→bleaching→fixing

(11) development→stopping→bleach fixing

The antifoaming agent of the invention could be used in any one or more of the above steps in addition to the development step, depending on where the hydrophilic polymer is dissolved. Thus, the antifoaming agent can be added the surfactant is in any one or more photoprocessing solutions corresponding to these steps, including the developing, bleaching, fixing, bleach-fixing and/or wash solution. Preferably, the surfactant is added to the processing solutions in which most of the hydrophilic polymer is released into solution, this typically being the first solution in which it is immersed, commonly the developer solution, which also has a sufficiently high pH to ionize the water dispersible polymer, thereby aiding wash out of the hydrophilic polymer. The surfactant may also be added to one or more subsequent processing solutions, including the blix solution.

The present invention is illustrated by the following examples. Unless otherwise indicated, the molecular weights herein are weight average molecular weights, as determined by size exclusion chromotagraphy described below.

EXAMPLES

Characterization of Polymeric Materials

Glass Transition Temperature and Melting Temperature

Both glass transition temperature (Tg) and melting temperature (Tm) of the dry polymer material were determined by differential scanning calorimetry (DSC), using a ramping rate of 20° C./minute. Tg is defined herein as the inflection point of the glass transition and Tm is defined herein as the peak of the melting transition.

Particle Size Measurement

All particles were characterized by Photon Correlation Spectroscopy using a Zetasizer® Model DTS5100 manufactured by Malvern Instruments.

Average Molecular Weight

Polymer samples were analyzed by size-exclusion chromatography in tetrahydrofuran using three Polymer Laboratories Plgel®mixed-C columns. The column set was calibrated with narrow-molecular-weight distribution polystyrene standards between 595 (log M=2.76) and 2170000 (log M=6.34) daltons. The number average ($M_n$) and weight average ($M_w$) were reported. The poly(vinyl alcohol) samples were analyzed by size-exclusion chromatography (SEC) in dimethyl sulfoxide (DMSO) containing 0.01M lithium nitrate using one Jordi Gel GBR mixed-bed column. The column set was calibrated with narrow-molecular-weight distribution pullulan standards between MW 5,900 (log M=3.77) and MW 788,000 (log M=5.90). Results were plotted as pullulan equivalent molecular weights and the number average ($M_n$) and weight average ($M_w$) were reported.

Hydrophobic Polymer Preparation

P1 Butyl Methacrylate Latex

To a 1L three-necked reaction flask fitted with a stirrer and condenser was added 300 ml of degassed distilled water, 2 ml of 45% Dowfax® 2A1, 1.00 grams of potassium persulfate, and 0.33 grams of sodium metabisulfite.

The flask was placed in a 60° C. bath and the contents of an addition flask containing 100 ml of distilled water, 2 ml of 45% Dowfax® 2A1, 95 grams of n-butyl methacrylate and 5 grams of 2-sulfo-1,1-dimethylethyl acrylamide (sodium salt) was added to the reaction flask over a period of 40 minutes. The reaction flask was stirred at 80° C. for 1 hour and 0.25 g of potassium persulfate was added and the contents stirred at 80° C. for additional 90 minutes. The flask was cooled and the pH of the latex was adjusted to 5.5 using 10% sodium hydroxide to give a latex containing 20% solids. The Tg of the polymer was 35 C.

P2 Ethyl Acrylate/Vinylidene Chloride/Hydroxyethyl Acrylate Latex (10/88/2)

To a 20-ounce polyethylene bottle was added 341 grams of demineralized water. The water was purged for 15–20 minutes with nitrogen. Th e following were added to the reactor in order: 5.10 grams of 30% Triton® 770, 3.06 grams of hydroxyethyl acrylate, 15.29 grams of ethyl acrylate, 134.59 grams of vinylidene chloride, 0.7586 grams of potassium metabisulfite, and 0.3794 grams of potassium persulfate. The bottle was capped and placed in a tumbler bath at 40° C., and held there for 16–20 hours. The product was then removed from the bath, and cooled to 20° C. The product was filtered through cheesecloth. Glass transition temperature was 9° C. as measured by DSC, average particle size obtained from PCS was 75 nm.

P3 (Polyurethane Dispersion)

In a 1 liter resin flask equipped with thermometer, stirrer, water condenser and a vacuum outlet, melted 75.68 grams (0.088 mole) polycarbonate polyol KM101733 (Mw=860) and dewatered under vacuum at 100° C. Released vacuum and at 40° C. added 10.25 grams (0.076 mole) of dimethylol propionic acid, 30.28 grams (0.336 mole) of 1,4-butanediol, 75 grams of tetrahydrofuran and 15 drops of dibutyltin dilaurate (catalyst) while stirring. Adjusted temperature to75° C. when a homogeneous solution was obtained, slowly added 111.28 grams (0.50 mole) of isophorone diisocyanate followed by 25 grams of tetrahydrofuran. For this polymer, the monomer feed ratio on a weight basis was 33.3% polycarbonate polyol, 4.5% dimethylol propionic acid, 13.3% butanediol and 48.9% isophorone diisocyanate. After maintaining for about 4 hours to complete the reaction, NCO was substantially nil. Stirred in a stoichometric amount of potassium hydroxide based on dimethylol propionic acid, and maintained for 5 min. Mixed with 1300 grams of water under high shear to form a stable aqueous dispersion. Tetrahydrofuran was removed by heating under vacuum to give an aqueous dispersion at 19.1% solids. Glass transition temperature was 53° C. as measured by DSC, weight average molecular weight was 11,000 and particle size was 30 nm.

P4 (Polyurethane Dispersion

The same preparation scheme was used as for P3 except diethylene glycol was substituted for a portion of the 1,4-butanediol as chain extender, such that the monomer feed ratio on a weight basis was 33.0% polycarbonate polyol, 4.4% dimethylol propionic acid, 9.5% butanediol, 4.3% diethylene glycol and 48.9% isophorone diisocyanate. Tetrahydrofuran was removed by heating under vacuum to give an aqueous dispersion at 19.5% solids. Glass transition temperature was 55° C. as measured by DSC, and weight average molecular weight was 19,100.

P5 (Polyurethane Dispersion)

The same preparation scheme was used as for P3 except diethylene glycol was substituted for a portion of the 1,4-butanediol and the relative amounts of other components were adjusted such that the monomer feed ratio on a weight basis was 44.3% polycarbonate polyol, 4.6% dimethylol propionic acid, 6.5% butanediol, 3.6% diethylene glycol and 43.0% isophorone diisocyanate. Tetrahydrofuran was removed by heating under vacuum to give an aqueous dispersion at 25.3% solids. Glass transition temperature was 33° C. as measured by DSC, and weight average molecular weight was 12,600.

P6 (Polyurethane-Acrylic Copolymer Dispersion)

Into a dry reactor was charged 96 grams of a diol (Millester® 9–55, MW2000 from Polyurethane Corporation of America), 87 grams of the methylene bis(4-cyclohexyl) isocyanate (Desmodur®W) and 0.02 grams of dibutyltin dilaurate (Aldrich). The mixture was held with stirring for 90 minutes at 94° C. under a blanket of argon after which 14 grams of dimethylol propionic acid was added to the reactor and the mixture stirred for 1.5 hours at 94° C. At this point 24 grams of methyl methacrylate were added and stirred for 1 hour at the same temperature. The resultant prepolymer was cooled to below 40° C., dissolved in a vinyl monomer mixture consisting of 113 grams of n-butyl acrylate, 183 grams of methyl methacrylate, and 5 grams of acetoacetoxyethyl methacrylate, and then treated with 11 grams of triethylamine and 2.5 grams of initiator (AIBN). To this mixture was added 1000 ml deoxygenated water followed by 10 grams of ethylene diamine in 20 grams of water. The dispersion was heated to 65° C., held there with, stirring for 2 hours and heated further to 80° C. for 10 hours. The resulting dispersion of the urethane acrylic copolymer had an acid number of 11.

P7 (Epoxy Dispersion)

An organic phase was made by dissolving 270 grams of Carboset) 525 acrylic coplymer (BF Goodrich Specialty Chemicals) followed by 630 grams of Epon® 1001 F epoxy resin (Shell Chemical Co.), in 2100 grams of a 90:10 solvent mixture of ethyl acetate and acetone. 1000 grams of the organic phase was then neutralized with 40 grams of isopropanol and 19.5 grams of triethyl amine. An aqueous phase was prepared by mixing 220 grams of a 10% Alkanol® XC surfactant solution with 37 grams of a 30% poly(vinyl alcohol) solution (Aldrich. Cat. No. 36,062-7) and 1943 grams of water. The neutralized organic and aqueous phases were mixed and passed through a microfluidizer for 5 passes at 3500 psi. Volatile solvents were stripped from the dispersed mixture by purging the space above the dispersion with nitrogen at 35° C. or by removing with a rotary evaporator. The resulting dispersion was approximately 14% solids, and had a particle size of 100 nm and a Tg of 44° C.

P8 (Epoxy Dispersion)

This dispersion was made in a similar fashion to P7 but used 450 grams of Carboset® 525 and 450 grams of an epoxy resin sold by Aldrich Chemical Company under Catalog Number 40,804-2. The resulting dispersion had a particle size of 100 nm and a Tg of 38° C.

P9 (Polyester Ionomer Dispersion)

AQ-55, a polyester ionomer dispersion, was used as-received from Eastman Chemical Co. The Tg of this material was 55° C.

P10 (Polyurethane Dispersion)

The same preparation scheme was used as for P3 except bisphenol A was substituted for a portion of the 1,4-butanediol and the relative amounts of other components were adjusted such that the monomer feed ratio on a weight basis was 41.0% polycarbonate polyol, 3.9% dimethylol propionic acid, 8.1% butanediol, 6.2% bisphenol A and 40.0% isophorone diisocyanate. Tetrahydrofuran was removed by heating under vacuum to give an aqueous dispersion at 27.8% solids. Glass transition temperature was 42° C. as measured by DSC, and weight average molecular weight was 34,100.

P11 (Polyurethane Dispersion)

The same preparation scheme was used as for P5 except that the polycarbonate polyol content was reduced from 44% to 42% and the remaining 2% was replaced by an aminopropyl end-functionalized polysiloxane PS510, obtained from Petrarch. Tetrahydrofuran was removed by heating under vacuum to give an aqueous dispersion at 23.7% solids. Glass transition temperature was 30° C. as measured by DSC, and weight average molecular weight was 19,600.

P12 Polyethylene Dispersion

ChemCor® Emulsion 260, an anionic high density polyethylene emulsion, P12, was purchased from Chemical Corporation of America and used as received.

P13 Ethyl Acrylate/Vinylidene Chloride/Itaconic Acid Latex (10/88/2)

The same preparation was used as for the polymer P2 except itaconic acid was substituted for hydroxyethyl acrylate. The Tg of the polymer was 9° C. and the particle size was 77 nm.

P14 Acrylonitrile/Vinylidene Chloride/Acrylic Acid Latex (39/59/2)

The same preparation was used as for the polymer P2 except for using 59.67 g of acrylonitrile, 90.27 g of vinylidene chloride and 3.06 g of acrylic acid. The Tg of the polymer is 79° C. and the particle size was 85 nm.

P15 Methyl Acrylate/Vinylidene Chloride/Itaconic Acid Latex (15/83/2)

The same preparation was used as for the polymer P2 except for using 22.95 g of methylacrylate, 126.99 g of vinylidene chloride and 3.06 g of itaconic acid. The Tg of the polymer is 25° C. and the particle size was 97 nm.

Hydrophylic Polymer and Additional Materials (1) Airvol® 203 poly(vinyl alcohol) (PVA) was obtained from Air Products which was 87 to 89% hydrolyzed (by hydrolyzed is meant that the acetate groups in the monomeric units are converted to hydroxy groups) and had a number-average molecular weight of 12,000 and a weight-average molecular weight of 35,000.

(2) CX-100®, a polyfunctional aziridine crosslinker for the polyurethane-acrylic copolymer dispersion, was obtained from Neo Resins (a division of Avecia).

(3) Protex® 6L, a protease enzyme, was purchased from Genenco, liquid, used as received.

(4) Accusol® 882, a water-soluble associative thickener used as a viscosifying agent, was obtained from Rohm & Haas, Inc. and used as received.

(5) Poly(ethyl oxazoline) was purchased from Aldrich Chem. Co. and used as received.

Photographic sample preparation

Samples was prepared by coating in sequence blue-light sensitive layer, interlayer, green-light sensitive layer, UV layer, red-light sensitive layer, UV layer and overcoat on photographic paper support. The components in each individual layer are described below.

Blue Sensitive Emulsion (Blue EM-1)

A high chloride silver halide emulsion is precipitated by adding approximately equimolar silver nitrate and sodium chloride solutions into a well stirred reactor containing glutaryldiaminophenyldisulfide, gelatin peptizer and thioether ripener. Cesium pentachloronitrosylosmate(II) dopant is added during the silver halide grain formation for most of the precipitation, followed by the addition of potassium hexacyanoruthenate(II), potassium (5-methylthiazole)-pentachloroiridate, a small amount of KI solution, and shelling without any dopant. The resultant emulsion contains cubic shaped grains having edge length of 0.6 $\mu$m. The emulsion is optimally sensitized by the addition of a colloidal suspension of aurous sulfide and heat ramped to 60° C. during which time blue sensitizing dye BSD-4, potassium hexchloroiridate, Lippmann bromide and 1-(3-acetamidophenyl)-5-mercaptotetrazole were added.

Green Sensitive Emulsion (Green EM-1)

A high chloride silver halide emulsion is precipitated by adding approximately equimolar silver nitrate and sodium chloride solutions into a well stirred reactor containing, gelatin peptizer and thioether ripener. Cesium pentachloronitrosylosmate(II) dopant is added during the silver halide grain formation for most of the precipitation, followed by the addition of potassium (5-methylthiazole)-pentachloroiridate. The resultant emulsion contains cubic shaped grains of 0.3 $\mu$m in edge length size. The emulsion is optimally sensitized by the addition of glutaryldiaminophenyldisulfide, a colloidal suspension of aurous sulfide and heat ramped to 55° C. during which time potassium hexachloroiridate doped Lippmann bromide, a liquid crystalline suspension of green sensitizing dye GSD-1, and 1-(3-acetamidophenyl)-5-mercaptotetrazole were added.

Red Sensitive Emulsion (Red EM-1)

A high chloride silver halide emulsion is precipitated by adding approximately equimolar silver nitrate and sodium chloride solutions into a well stirred reactor containing gelatin peptizer and thioether ripener. During the silver halide grain formation, potassium hexacyanoruthenate(II) and potassium (5-methylthiazole)-pentachloroiridate are added. The resultant emulsion contains cubic shaped grains of 0.4 $\mu$m in edgelength size. The emulsion is optimally sensitized by the addition of glutaryldiaminophenyldisulfide, sodium thiosulfate, tripotassium bis {2-[3-(2-sulfobenzamido)phenyl]-mercaptotetrazole} gold(I) and heat ramped to 64° C. during which time 1-(3-acetamidophenyl)-5-mercaptotetrazole, potassium hexachloroiridate, and potassium bromide are added. The emulsion is then cooled to 40° C., pH adjusted to 6.0 and red sensitizing dye RSD-1 is added.

Coupler dispersions were emulsified by methods well known in the art. The following imaging layers were coated in sequence on polyethylene-laminated photographic paper.

| Layer | Item | Laydown (mg/ft$^2$) |
|---|---|---|
| Layer 1 | Blue Sensitive Layer | |
| | Gelatin | 122.0 |
| | Blue sensitive silver (Blue EM-1) | 22.29 |
| | Y-4 | 38.49 |
| | ST-23 | 44.98 |
| | Tributyl Citrate | 20.24 |
| | ST-24 | 11.25 |
| | ST-16 | 0.883 |
| | Sodium Phenylmercaptotetrazole | 0.009 |
| | Piperidino hexose reductone | 0.2229 |
| | 5-chloro-2-methyl-4-isothiazolin-3-one/2-methyl-4-isothiazolin-3-one (3/1) | 0.019 |
| | SF-1 | 3.40 |
| | Potassium chloride | 1.895 |
| | Dye-1 | 1.375 |
| Layer 2 | Interlayer | |
| | Gelatin | 69.97 |
| | ST-4 | 9.996 |
| | Diundecyl phthalate | 18.29 |
| | 5-chloro-2-methyl-4-isothiazolin-3-one/2-methyl-4-isothiazoline-3-one (3/1) | 0.009 |
| | Catechol disulfonate | 3.001 |
| | SF-1 | 0.753 |
| Layer 3 | Green Sensitive Layer | |
| | Gelatin | 110.96 |
| | Green sensitive silver (Green EM-1) | 9.392 |
| | M-4 | 19.29 |
| | Oleyl Alcohol | 20.20 |
| | Diundecyl phthalate | 10.40 |
| | ST-1 | 3.698 |
| | ST-3 | 26.39 |
| | Dye-2 | 0.678 |
| | 5-chloro-2-methyl-4-isothiazolin-3-one/2-methyl-4-isothiazolin-3-one (3/1) | 0.009 |
| | SF-1 | 2.192 |
| | Potassium chloride | 1.895 |
| | Sodium Phenylmercaptotetrazole | 0.065 |
| Layer 4 | M/C Interlayer | |
| | Gelatin | 69.97 |
| | ST-4 | 9.996 |
| | Diundecyl phthalate | 18.29 |
| | Acrylamide/t-Butylacrylamide sulfonate copolymer | 5.026 |
| | Bis-vinylsulfonylmethane | 12.91 |
| | 3,5-Dinitrobenzoic acid | 0.009 |
| | Citric acid | 0.065 |
| | Catechol disulfonate | 3.001 |
| | 5-chloro-2-methyl-4-isothiazolin-3-one/2-methyl-4-isothiazolin-3-one (3/1) | 0.009 |

-continued

| | | |
|---|---|---|
| Layer 5 | Red Sensitive Layer | |
| | Gelatin | 125.96 |
| | Red Sensitive silver (Red EM-1) | 17.49 |
| | IC-35 | 21.59 |
| | IC-36 | 2.397 |
| | UV-1 | 32.99 |
| | Dibutyl sebacate | 40.49 |
| | Tris(2-ethylhexyl)phosphate | 13.50 |
| | Dye-3 | 2.127 |
| | Potassium p-toluenethiosulfonate | 0.242 |
| | 5-chloro-2-methyl-4-isothiazolin-3-one/2-methyl-4-isothiazolin-3-one (3/1) | 0.009 |
| | Sodium Phenylmercaptotetrazole | 0.046 |
| | SF-1 | 4.868 |
| Layer 6 | UV Overcoat | |
| | Gelatin | 76.47 |
| | UV-2 | 3.298 |
| | UV-1 | 18.896 |
| | ST-4 | 6.085 |
| | SF-1 | 1.162 |
| | Tris(2-ethylhexyl)phosphate | 7.404 |
| | 5-chloro-2-methyl-4-isothiazolin-3-one/2-methyl-4-isothiazolin-3-one (3/1) | 0.009 |
| Layer 7 | SOC | |
| | Gelatin | 60.0 |
| | SF-1 | 1.0 |
| | SF-2 | 0.39 |

BSD-4

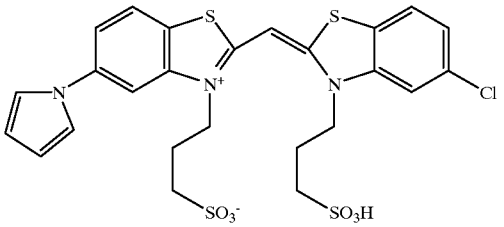

GSD-1

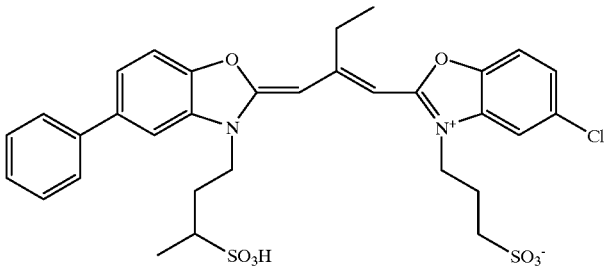

RSD-1

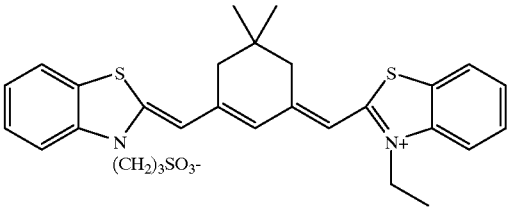

-continued
Y-4
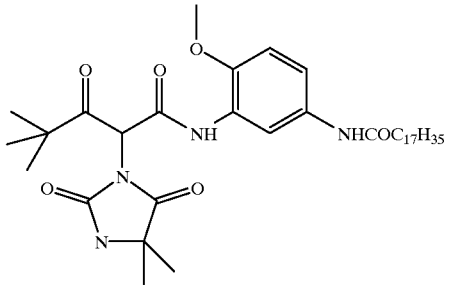
M-4
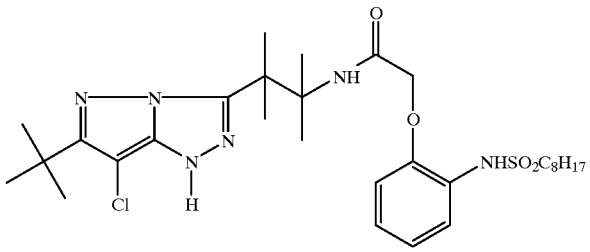
IC-35
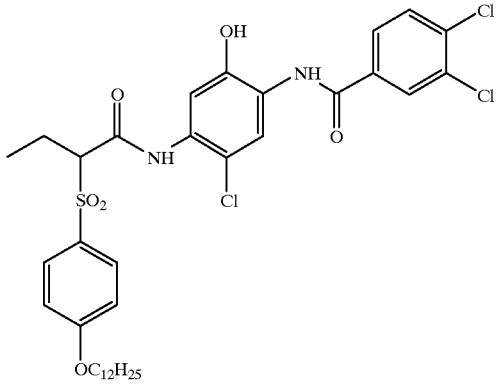
IC-36
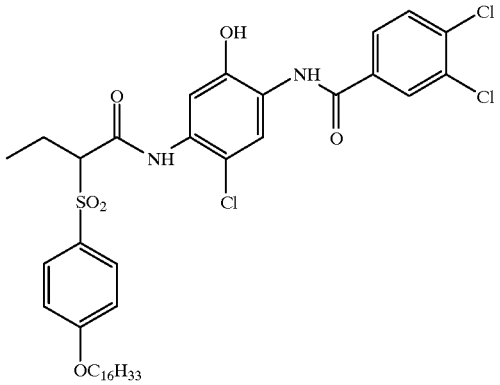

-continued
Dye-1
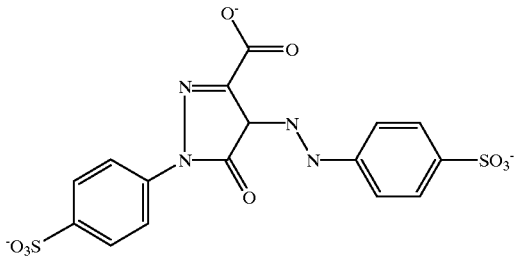
Dye-2
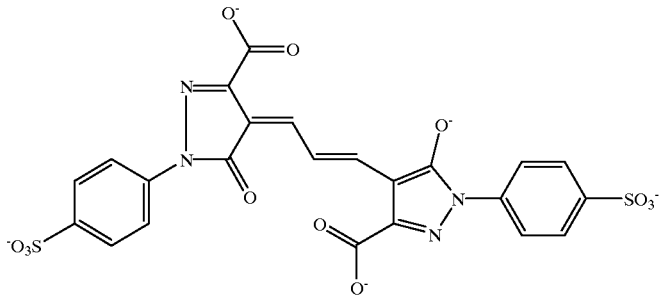
Dye-3
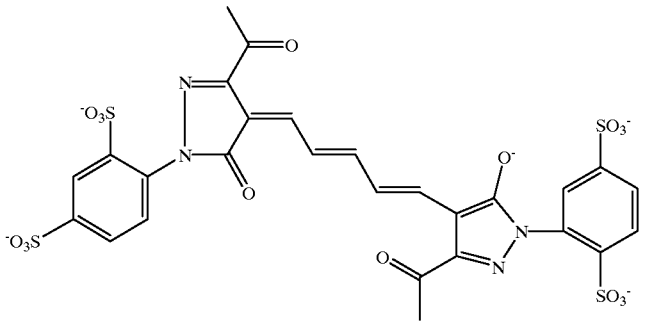
ST-1
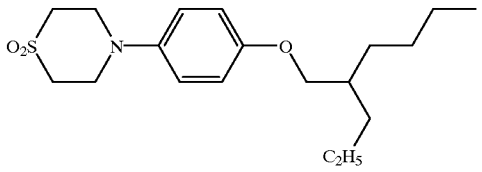
ST-3
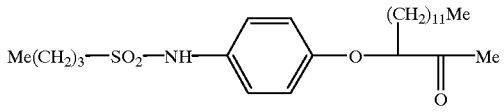
ST-4
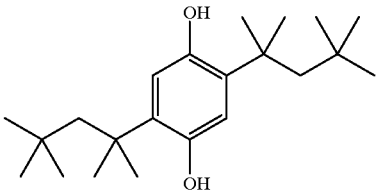

-continued
ST-16
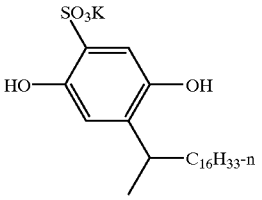
ST-23
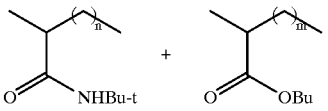
n:m = 1:1; MW = 75,000–100,000
ST-24
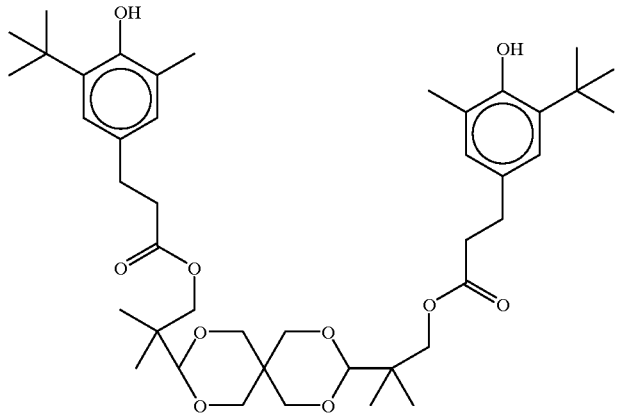
UV-1
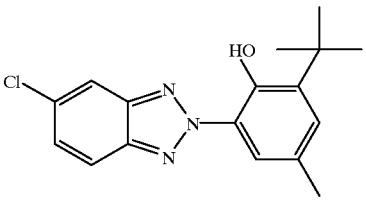
UV-2
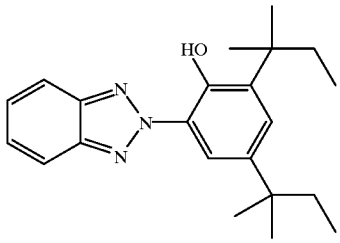
SF-1
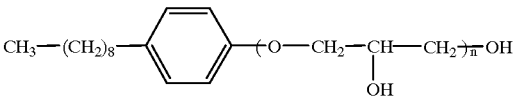
SF-2 $CF_3.(CF_2)_7.SO_3Na$ -continued

| Standard RA-4 process steps and conditions: | | |
|---|---|---|
| Solution/Step | Time (seconds) | Temperature (° F.) |
| (1) Prime SP Developer | 45 | 100 |
| (2) Prime Bleach-Fix | 45 | 86–97 |
| (3) Prime Stabiliser | 90 | 86–99 |
| (4) Drying | As needed | Generally at least 140; not to exceed 205 |

Example 1

This Example illustrates a color photographic paper that may be processed according to the present invention. Samples were prepared by replacing the standard gelatin-containing overcoat with an overcoat consisting of poly (vinyl alcohol) (PVA) and polymer P6, the materials described above. The protective overcoat was coated over a paper structure previously coated with layers 1 through 6 as described above. The overcoat composition (in mg/sq.ft.) consisted of 175 P6, 61 PVA, and 1.75 CX-100). The overcoat exhibited 96% water resistance after standard processing.

To determine the amount of PVA washed out during RA 4 processing, multiple coatings were run through RA 4 process and the seasoned developer solution, bleach/fix solution and wash solution were analyzed by Size Exclusion Chromatography as follows. Aliquots of sample were dried first and then re-dissolved in dimethyl sulfoxide containing 0.01 M lithium nitrate. Jordi Gel GBR mix-bed column was used for the analysis and the column was calibrated with narrow molecular weight distribution pullulan standards between molecular weight 5900 and 788000. The PVA peak in analyzed sample was confirmed by matching the same elution time with standard pure PVA peak under the same experimental condition. The relative amount of PVA washed out during each step of RA 4 processing was determined. The results indicated that at least 86% of the PVA was washed out during RA 4 process. Of that amount, 55% was washed out in developer solution and 45% of that was washed out in the wash. The amount washed out in the bleach/fix was undetectable.

Example 2

This Example illustrates a color photographic paper that can be processed according to the present invention, in which samples were prepared by coating water-dispersible polyurethane particles in non-crosslinked gelatin in two different ways:

Method 1

A solution of Protex® 6L enzyme was mixed into an overcoat coating solution, containing gelatin and polyurethane P4, just prior to the point of coating application, at a ratio of 1 part enzyme to 10 parts gelatin. Separate experiments confirmed that the time between mixing and drying of the coating was sufficiently long that the enzyme digested the gelatin in the overcoat layer sufficiently to render the gelatin non-crosslinkable.

Method 2

A solution of Protex® 6L enzyme was mixed into an aqueous solution of poly(vinyl pyrilidone) (PVP) at a ratio of 1 part enzyme to 4 parts PVP. This solution was coated, as the uppermost layer at a laydown of 80 mg/sq ft of PVP, over a next-to-uppermost layer containing gelatin and polyurethane. Separate experiments confirmed that the time between coating application and drying of the coating was sufficiently long that the enzyme delivered in the uppermost layer digested the gelatin in the next-to-uppermost layer sufficiently to render the gelatin non-crosslinkable, and that the PVP readily dissolves and is removed in photographic processing.

The results are reported in Table 1 below.

TABLE 1

| Example ID | Overcoat Composition (in mg/sq. ft.) | Method of Enzyme Delivery | % Water resistance after standard processing |
|---|---|---|---|
| 2-A | 160 P4<br>40 enzyme-digested gelatin | Method 1 | 17% |
| 2-B* | 160 P4<br>40 enzyme-digested gelatin | Method 2 | 61% |

Table 1 shows that upon processing the enzyme-digested gelatin is washed out into solution, allowing the water-dispersible polymers to form a water-resistant layer.

Example 3

This Example illustrates color photographic papers that can be processed according to the present invention, in which samples were prepared by replacing the standard gelatin-containing overcoat with an overcoat consisting of poly(vinyl alcohol) (PVA) and polymer P5 and P7 to P 15. In the case of sample 3-A2 below, the protective overcoat was coated over a paper structure previously coated with layers 1 through 6 as described above. The results are shown in Table 2 below.

TABLE 2

| Example ID | Overcoat Composition (in mg/sq. ft.) | % Water resistance after standard processing |
|---|---|---|
| 3-A1 | 175 P9<br>61 PV A | 97 |
| 3-A2 | 175 P9<br>61 PV A | >95 |
| 3-B | 140 P7<br>55 PV A<br>15 Accusol ® 882 thickener | 99 |
| 3-C | 140 P8<br>45 PV A<br>13 Accusol ® 882 | 98 |
| 3-D | 160 P5<br>50 PV A | >99 |
| 3-E | 160 P10<br>50 PV A | >99 |
| 3-F | 160 P11<br>50 PV A | >99 |
| 3-G | 175 P12<br>61 PV A | 89 |

TABLE 2-continued

| Example ID | Overcoat Composition (in mg/sq. ft.) | % Water resistance after standard processing |
|---|---|---|
| 3-H | 175 P13<br>61 PV A | 97 |
| 3-I | 175 P14<br>61 PV A<br>1.75 CX 100 | 86 |
| 3-J | 175 P15<br>61 PV A<br>1.75 CX 100 | 93 |
| 3-K | 175 P13<br>44 PEOx | 97 |

Example 4

The foaming behavior of a developer solution containing polyvinyl alcohol was tested with various surfactants. The developer solution used was based on RA-12 chemistry which is used to process photographic color paper. The developer solution had the composition show in Table 3 below.

TABLE 3

| Component | Quantity /L |
|---|---|
| Versa ® TL-73 Lithium polystyrene sulfonate (30% w/w solution) | 0.25 mL |
| Potassium Sulfite (45%) | 0.5 mL |
| KODAK ® Balancing Developer Agent, BD-89 Diethylhydroxylamine (85% w/w solution) | 2.72 mL |
| Blankophor ® REU 170 (phorwite) | 0.82 g |
| Lithium Sulfate | 2.12 g |
| KODAK ® Anti-Calcium No. 5 (1-Hydroxyethylidene-1, 1-diphosphonic acid, 60% w/w solution) | 0.60 mL |
| Potassium Chloride | 5.55 g |
| Potassium Bromide | 0.028 g |
| KODAK ® Color Developing Agent, CD-3 | 3.74 g |
| Potassium Carbonate | 25.0 g |
| pH at 25.0° C. (77.0° F.) | 10.134 |
| Specific Gravity at 25.0° C. | 1.032 |

The polyvinyl alcohol (PVA), namely V2 (Airvol™ 203), was obtained from Air Products and has an average molecular weight of 13–23K and is 87–89% hydrolyzed. PVA was added to the developer solution at a level of 0.1 g/L, which is about the midpoint of the expected range of the PVA concentration expected to be present in the processing solution. The antifoam was added to the PVA containing developer solution at 50 parts per million. The HLB values of these antifoam/surfactants are based on the values reported by the respective manufacturers, except where noted. After 10 ml of the solution was taken in a 25 ml graduated cylinder which had a diameter of 1 cm, the cylinder was immersed in a 37° C. bath which is the operating temperature of the developer. It was then shaken manually till the foam height remained constant. After the shaking was stopped, the initial foam volume (total volume of the developer and associated foam) was noted and the time for the foam to decay to 11 ml was noted. The results are shown in Table 3 below. Table 4 shows the solubility of various anti foams.

TABLE 3

| Antifoams | Note | HLB | Dispersibility in Developer | Initial foam volume | Time to decay to 11 ml |
|---|---|---|---|---|---|
| None | Control | N/A | N/A | 21 | 10 min |
| Silwet ® L7220 (Witco) | Invention | 5–8 | Soluble with slight turbidity | 12 | 18 sec |
| Silwet ® L7230 (Witco) | Invention | 9–12 | Soluble, clear | 13 | 20 sec |
| Silwet ® L7210 (Witco) | Invention | 5–8 | Soluble with turbidity | 11 | 0 |
| Silwet ® L7602 (Witco) | Comparison | 5–8 | Soluble, clear | 13 | 18 sec |
| Pluronic ® L61 (BASF) | Invention | 3 | Soluble with slight turbidity | 11 | 0 |
| Tetronic ® 90R4 (BASF) | Invention | 7 | Soluble, clear | 16 | 38 sec |
| Tetronic ® 701 (BASF) | Invention | 3 | Soluble with turbidity | 11 | 0 |
| Tetronic ® 150R1 (BASF) | Comparison | 1 | Oil drops/ particles | 12 | 5 sec |
| Fluorad ® FC171 (3M) | Invention | 2.8* | Soluble, Clear | 13 | 5 sec |

*Calculated value

TABLE 4

| Antifoam | Solubility at RT, ppm | Note | Solubility at 40° C., ppm |
|---|---|---|---|
| Pluronic ® L61 | 500 | Invention | 500 |
| Pluronic ® 90R4 | >1000 | Invention | 500 |
| Tetronic ® 701 | 500 | Invention | 500 |
| Tetronic ® 150R1 | <10 | Comparison | 50 |
| Silwet ® L7220 | 100–250 | Invention | 100–250 |
| Silwet ® L7230 | >1000 | Invention | >1000 |
| Silwet ® L7602 | 50 | Comparison | 50 |
| Silwet ® L7210 | >1000 | Invention | >1000 |
| Fluorad ® FC171 | <100 | Invention | <100 |
| Brij ® 93 | <50 ppm | Comparison | <50 ppm |
| Brij ® 30 | <500 | Invention | <500 |

As seen in the above Tables, the surfactants in the required HLB and solubility range provide a large reduction in the volume of the foam produced as well as its stability. At low HLB values, the solubility of the surfactant is low and forms a second phase at the operating concentrations. This could cause a potential problem with the shelf stability of the processing solutions. The second phase could also interact with the surfaces of the hardware.

Example 5

The sensitometric effect of various antifoaming agents in the developer solution was evaluated using RA-12 chemistry. PVA at a level of 0.1 g/L was added to the developer solution and the various antifoamants were added at 100 ppm level. Kodak® Edge 8 paper and polymer overcoated Edge® 8 paper were used for the evaluation. The overcoat composition was the same as in Example 1 above.

The sensitometric effect of antifoam in developer on Edge® 8 paper, in particular, the shoulder and toe values of Edge® 8 paper and Edge® 8 paper overcoated as in Example 1 above, are listed in Table 5. The sensitometric effect of antifoaming agent in the developer on polymer overcoated Edge® 8 paper is shown in Table 6 below.

TABLE 5

| Sample | Red Shld | Green Shld | Blue Shld | Red Toe | Green Toe | Blue Toe |
|---|---|---|---|---|---|---|
| Check | 1.795 | 1.705 | 1.820 | 0.217 | 0.186 | 0.167 |
| Silwet ® L7210 | 1.805 | 1.714 | 1.822 | 0.215 | 0.186 | 0.165 |
| Silwet ® L7220 | 1.797 | 1.717 | 1.817 | 0.216 | 0.186 | 0.167 |
| Silwet ® L7230 | 1.797 | 1.707 | 1.810 | 0.214 | 0.186 | 0.166 |
| Tetronic ® 701 | 1.797 | 1.707 | 1.816 | 0.216 | 0.186 | 0.167 |
| Tetronic ® 90R4 | 1.880 | 1.781 | 1.865 | 0.213 | 0.183 | 0.165 |

TABLE 6

| Sample | Red Shld | Green Shld | Blue Shld | Red Toe | Green Toe | Blue Toe |
|---|---|---|---|---|---|---|
| Check | 1.823 | 1.678 | 1.758 | 0.206 | 0.177 | 0.166 |
| Silwet ® L7210 | 1.859 | 1.728 | 1.757 | 0.203 | 0.171 | 0.164 |
| Silwet ® L7220 | 1.858 | 1.735 | 1.754 | 0.203 | 0.172 | 0.165 |
| Silwet ® L7230 | 1.855 | 1.711 | 1.751 | 0.203 | 0.172 | 0.165 |
| Tetronic ® 701 | 1.835 | 1.713 | 1.761 | 0.206 | 0.174 | 0.167 |
| Tetronic ® 90R4 | 1.927 | 1.796 | 1.801 | 0.199 | 0.167 | 0.163 |

The results in Tables 5 and 6 indicate that there was no significant sensitometric effect due to the addition of the antifoaming agent to the developer solution at 100 ppm.

Example 6

Gelatin was added at a level of 0.5 wt % to the developer solution having the same formulation as specified in Example 4 above. The gelatin used was a Type IV gelatin whose weight average molecular weight as determined by size exclusion chromatography was 161,000. Various antifoaming agents were added at a level of 50 ppm and the foam test described in Example 4 was repeated with the following results in Table 7 below.

TABLE 7

| Antifoaming Agent | Note | HLB | Dispersibility in developer solution | Initial foam volume | Time to decay to 11 ml |
|---|---|---|---|---|---|
| None | Control | N/A | N/A | 25 | 35 min |
| Silwet L7220 (Witco) | Invention | 5–8 | Soluble with slight turbidity | 11 | 0 |
| Silwet L7230 (Witco) | Invention | 9–12 | Soluble, clear | 11 | 0 |
| Silwet L7210 (Witco) | Invention | 5–8 | Soluble with turbidity | 13 | 2 sec |
| Silwet L7602 (Witco) | Invention | 5–8 | Soluble, clear | 13 | 2 sec |
| Tetronic 90R4 (BASF) | Invention | 7 | Soluble, clear | 14 | 30 sec |
| Tetronic 701 (BASF) | Invention | 3 | Soluble with turbidity | 11 | 0 |
| Fluorad FC171 (3M) | Invention | N/A | Soluble, Clear | 13 | 2 sec |
| Pluronic L101 | Invention | 1 | Particles | 11 | 0 |
| Pluronic L44 | Comparison | 16 | Soluble | 17 | 1 min |
| Tetronic 904 | Comparison | 15 | Soluble | 17 | 40 min |
| POE(10) Lauryl Ether | Comparison | 14.3 | Soluble | 18 | 40 min |
| Pluronic F108 | Comparison | 27 | Soluble | 19 | 30 min |

As shown by the above results, the surfactants within the required HLB range are effective in controlling or eliminating the foamability of developer solutions containing 0.5 wt % gelatin. Those surfactants with HLB values above 12 were poor for the amount of initial foam or for the time for the foam to break. Some of them even increased the stability of the foam over that of the gelatin solution.

Example 7

A similar experiment to the one described in Example 6 was carried out. In this case, a low molecular weight gelatin was used to simulate the enzymatic hydrolysis of gelatin that can occur as described in Example 2 above. The molecular weight of the gelatin used in this example, as determined by size exclusion chromatography, was 14,000. The gelatin in question was prepared by hydrolyzing gelatin at a temperature of 80° C. and a pH of 2.0 for 24 hours. The foam results obtained are shown below in Table 8.

TABLE 8

| Antifoam | HLB | Dispersibility in developer solution | Initial foam volume | Time to decay to 11 ml |
|---|---|---|---|---|
| None | N/A | N/A | 25 | 15 min |
| Silwet ® L7220 (Witco) | 5–8 | Soluble with slight turbidity | 11 | 0 |
| Silwet ® L7230 (Witco) | 9–12 | Soluble, clear | 11 | 0 |
| Silwet ® L7210 (Witco) | 5–8 | Soluble with turbidity | 11 | 0 sec |
| Silwet ® L7602 (Witco) | 5–8 | Soluble, clear | 13 | 2 sec |
| Tetronic ® 90R4 (BASF) | 7 | Soluble, clear | 15 | 20 sec |
| Tetronic ® 701 (BASF) | 3 | Soluble with turbidity | 10 | 0 |

The foaming behavior of 0.5 wt. % of low molecular weight gelatin is seen to be a problem. It is also seen that the surfactants within the specified HLB range can control the foaming.

The invention has been described in detail with particular reference to certain preferred embodiments thereof, but it will be understood that variations and modifications can be effected within the spirit and scope of the invention.

What is claimed is:

1. A method of photoprocessing a photographic element, which method comprises:

(a) providing an imagewise exposed photographic element comprising a support, a silver-halide emulsion layer superposed on a side of said support, a processing-solution-permeable overcoat overlying the silver-halide emulsion layer, said overcoat having a laydown of at least 0.54 $g/m^2$ and comprising a water-insoluble hydrophobic polymer and a water-soluble hydrophilic polymer, such that at least 50% of the hydrophilic polymer is removed from the layer during the photoprocessing operation, wherein the amount of hydrophilic polymer is greater than 0.1 $g/m^2$;

(b) developing the photographic element in a developer solution having a pH greater than 7 and containing a nonionic surfactant having an HLB of less than 12 and a solubility at 25° C. of greater than 200 ppm, which nonionic surfactant is in the developer solution at a level less than 1000 ppm, whereby the surfactant substantially prevents the water-soluble polymer from foaming during photoprocessing even after a build-up of soluble hydrophilic polymer from photoprocessing a plurality of photographic elements in the same developing solution; and (c) drying the photographic element.

2. The method of claim 1 wherein the nonionic surfactant is in the developer solution at a level that is less than 200 ppm.

3. The method of claim 1 wherein the hydrophilic polymer is polyvinyl alcohol.

4. The method of claim 1 wherein the hydrophilic polymer is substantially uncrosslinked gelatin.

5. The method of claim 1 wherein the weight ratio of the hydrophobic polymer to the water-soluble hydrophilic polymer is between 50:50 to 90:10 and wherein the applied overcoat comprises less than 5% by weight of crosslinked gelatin.

6. The method of claim 1 wherein the build up of hydrophilic polymer in the developing solution from sequentially photoprocessing a plurality of photographic elements exceeds 0.02 grams/liter.

7. The method of claim 1 wherein the nonionic surfactant is alkoxylated poly(dimethyl siloxane).

8. The method of claim 1 wherein the nonionic surfactant is an ethoxylated alcohol.

9. The method of claim 1 wherein the nonionic surfactant is fluorinated.

10. The method of claim 1 wherein the nonionic surfactant is a polypropylene oxide-polyethylene oxide block copolymer.

11. The method of claim 1 wherein the level of said nonionic surfactant in the developer solution is less than 100 ppm.

12. The method of claim 1 wherein the overcoat is made from coating a composition comprising 30 to 95%, by weight of solids, of water-dispersible hydrophobic polymer in the form of particles having an average particle size of less than 500 nm and a $T_g$ between −40° C. and 80° C., and 5 to 70%, by weight of solids, of water-soluble hydrophilic polymer, wherein the weight ratio of water-dispersible polymer to water-soluble polymer is between 50:50 to 90:10.

13. The method of claim 1 wherein the coating composition comprises less than 5% by weight of gelatin.

14. The method of claim 1, further comprising fusing of the overcoat after drying.

15. The method of claim 1 wherein said hydrophobic polymer is selected from the group consisting of polyesters, polyamides, polyurethanes, polyureas, polyethers, polycarbonates, polyacid anhydrides, polymers derived from vinyl ethers, vinyl heterocylic compounds, styrenes, olefins, halogenated olefins, unsaturated acids and esters thereof, unsaturated nitrites, vinyl alcohols, acrylamides and methacrylamides, and vinyl ketones, poly(epoxides) and copolymers thereof, and combinations thereof.

16. The method of claim 1 wherein said hydrophobic polymer comprises ionized or ionizable groups.

17. The method of claim 1 wherein said water-soluble hydrophilic polymer is selected from the group consisting of polyvinyl alcohol, cellulose ethers, poly(N-vinyl amides), polyacrylamides, polyesters, poly(ethylene oxide), dextrans, starch, uncrosslinked gelatin, whey, albumin, poly(acrylic acid), poly(ethyl oxazolines), alginates, gums, poly (methacrylic acid), poly(oxymethylene), poly (ethyleneimine), poly(ethylene glycol methacrylate), poly (hydroxy-ethyl methacrylate), poly(vinyl methyl ether), poly(styrene sulfonic acid), poly(ethylene sulfonic acid), poly(vinyl phosphoric acid) and poly(maleic acid), and combinations thereof.

18. The method of claim 1 wherein the weight average molecular weight of said water-soluble hydrophilic polymer is 1500 to 100,000.

19. The method of claim 1 wherein said hydrophobic polymer has an acid number of greater than or equal to 5.

20. The method of claim 1 wherein said water-soluble hydrophilic polymer is non-crosslinked gelatin formed by digestion with an enzyme present in the photographic element.

21. The method of claim 1 wherein the hydrophilic polymer is crosslinked gelatin, and the developer solution containing the nonionic surfactant, also contains a proteolytic enzyme.

* * * * *